US005561024A

United States Patent [19]

Fukuda et al.

[11] Patent Number: 5,561,024

[45] Date of Patent: Oct. 1, 1996

[54] METHOD OF MAKING ELECTROPHOTOGRAPHIC MEMBER

[76] Inventors: Tadaji Fukuda; Toshiyuki Komatsu, both of c/o Canon Kabushiki Kaisha 30-2, 3-chome, Shimomaruko, Ohta-ku, Tokyo, Japan

[21] Appl. No.: 465,182

[22] Filed: Jun. 5, 1995

Related U.S. Application Data

[62] Division of Ser. No. 323,837, Oct. 17, 1994, abandoned, which is a division of Ser. No. 238,787, May 6, 1994, Pat. No. 5,382,487, which is a continuation of Ser. No. 29,300, Mar. 8, 1993, abandoned, which is a continuation of Ser. No. 819,640, Jan. 10, 1992, abandoned, which is a continuation of Ser. No. 701,017, May 13, 1991, abandoned, which is a continuation of Ser. No. 569,387, Aug. 15, 1990, abandoned, which is a continuation of Ser. No. 442,411, Nov. 22, 1989, abandoned, which is a continuation of Ser. No. 339,885, Apr. 18, 1989, abandoned, which is a continuation of Ser. No. 102,763, Sep. 24, 1987, abandoned, which is a continuation of Ser. No. 886,944, Jul. 22, 1986, abandoned, which is a continuation of Ser. No. 674,711, Nov. 26, 1984, abandoned, which is a continuation of Ser. No. 457,696, Jan. 13, 1983, abandoned, which is a continuation of Ser. No. 216,280, Dec. 15, 1980, abandoned.

[30] Foreign Application Priority Data

Dec. 13, 1979 [JP] Japan ..... 161872
Dec. 26, 1979 [JP] Japan ..... 169576

[51] Int. Cl.[6] ..... G03G 5/082

[52] U.S. Cl. ..... 430/128

[58] Field of Search ..... 430/84, 128

[56] References Cited

U.S. PATENT DOCUMENTS 4,226,898 10/1980 Ovshinsky et al. ..... 430/84 X
4,265,991 5/1981 Hirai et al. ..... 430/84 X

*Primary Examiner*—Roland Martin

[57] ABSTRACT

An image forming member for electrophotography constructed with a substrate and a photoconductive layer formed thereon, wherein the photoconductive layer comprising an amorphous material containing therein silicon atom as the matrix and halogen atom as the constituent atom.

11 Claims, 5 Drawing Sheets

METHOD OF MAKING ELECTROPHOTOGRAPHIC MEMBER

This application is a division, of application Ser. No. 08/323,837, filed Oct. 17, 1994, now abandoned, which in turn, is a division of application Ser. No. 08/238,787, filed May 6, 1994, now U.S. Pat. No. 5,382,487, which is a continuation of application Serial No. 08/029,300, filed Mar. 8, 1993, now abandoned; which is a continuation of application Ser. No. 07/819,640, filed Jan. 10, 1992, now abandoned; which is a continuation of application Ser. No. 07/701,017, filed May 13, 1991, now abandoned; which is a continuation of application Ser. No. 07/569,387, filed Aug. 15, 1990, now abandoned; which is a continuation of application Serial No. 07/442,411, filed Nov. 22, 1989, now abandoned; which is a continuation of application Ser. No. 07/339,885, filed Apr. 18, 1989, now abandoned; which is a continuation of application Ser. No. 07/102,763, filed Sep. 24, 1987, now abandoned; which in turn is a continuation of application Ser. No. 06/886,944, filed Jul. 22, 1986, now abandoned; which is a continuation of application Ser. No. 06/674,711, filed Nov. 26, 1984, now abandoned; which in turn is a continuation of application Ser. No. 06/457,696, filed Jan. 13, 1983, now abandoned; which is a continuation of application Ser. No. 06/216,280, filed Dec. 15, 1980, now abandoned.

BACKGROUND OF THE INVENTION

1. Field of the Invention

This invention relates to an electrophotographic image forming member to be used for forming an image utilizing electromagnetic waves such as light (in the broad sense of the term, this includes ultra-violet rays, visible rays, infrared rays, X-rays, γ-rays, and so forth).

2. Description of Prior Art

For the photoconductive material constituting the photoconductive layer of the electrophotographic image forming member, there have so far been used generally various inorganic photoconductive materials such as Se, CdS, ZnO, etc., and various organic photoconductive materials such as poly-N-vinyl carbazole (PVK), trinitrofluorenone (TNF), etc.

With the electrophotographic image forming material using these photoconductive materials, however, there still remain many points to be solved. The present situation is such that various suitable electrophotographic image forming members are prepared and used by relaxing conditions for manufacture and use to a certain extent in accordance with individual circumstances. For instance, the electrophotographic image forming member using selenium (Se) alone as the photoconductive layer forming material has a narrow spectro-scopic sensitivity range, and, in order to broaden it, addition of tellurium (Te) and arsenic (As) has been contemplated and practiced. However, while the electrophotographic image forming member having such Se-type photoconductive layer containing therein Te and As can really improve its spectroscopic sensitivity range, it still possesses various disadvantages such that, due to its increasing light fatigue, when one and the same image original is repeatedly and continuously used for reproduction, there takes place lowering in density of the reproduced image and stain of the background (fogging in the white ground), or when other image originals are subsequently used for the reproduction, residual image of the preceding image original is reproduced (ghost phenomenon), and others. Moreover, when it is exposed to the corona discharge continuously and for multiple numbers of times, the surface of the Se-type photoconductive layer brings about crystallization or oxidation in the vicinity of the layer surface with the consequence that deterioration in the electrical characteristics of the photoconductive layer would be invited in no less occasions.

On the other hand, the electrophotographic image forming member using ZnO, CdS, etc. as the photoconductive layer forming material involves a number of parameters determining the electrical and photoconductive characteristics as well as the physico-chemical characteristics of the photoconductive layer due to its constituent material being basically of two-component type consisting of a photoconductive material and a resin binder, and due to its peculiarity of the photoconductive material that the particles thereof should be uniformly dispersed in the resin binder to form the layer. Accordingly, it has such disadvantage that, unless these various parameters are adjusted strictly and precisely, the photoconductive layer having the desired characteristics cannot be formed with satisfactory reproducibility, hence inviting decrease in the yield rate and lacking in the mass-productivity.

Further, the binder type photoconductive layer is porous in its structure due to peculiarity of the photoconductive material being dispersed in the binder. On account of this, the photoconductive layer is remarkably moisture-dependent, which is liable to bring about deterioration in the electrical characteristic when it is used in a highly humid atmosphere, and, in no small cases, the reproduced image of high quality cannot be obtained.

Furthermore, the porosity of the photoconductive layer permits intrusion of a developer into the layer at the time of the developing operation to not only cause capability of the toner image separation and toner cleaning to be decreased, but also cause the layer to be impossible for further use. In particular, when a liquid developer is used, the developer readily penetrates into the photoconductive layer together with its carrier solvent under acceleration by the capillary action, so that the abovementioned problems would become considerable.

The electrophotographic image forming member using the organic photoconductive materials such as PVK and TNF, which have recently drawn attention of all concerned, is inferior in its moisture-resistant property, corona-ion-resistant property, and cleaning property, is poor in its photosensitivity, is narrow in its spectroscopic sensitivity range in the visible light, is deviated to the side of the short wavelengths region, and possesses various other defects, so that it is useful only in a very limited extent. Moreover, some of these organic photoconductive materials are suspected to be carcinogenic, hence there is no assurance that most of them are totally harmless to the human body.

Separate from those electrophotographic image forming members as mentioned in the foregoing, there has recently been proposed a new type of electrophotographic image forming member constituted with a photoconductive layer made of hydrogenated amorphous silicon (hereinafter abbreviated as "a—Si:H") as disclosed in, for example, DOLS 2746967 and DOLS 2855718.

The electrophotographic image forming member having the photoconductive layer constructed with such a—Si:H has a number of excellent properties in comparison with the afore-mensioned electrophotographic image forming members. That is, the photoconductive layer of either polarity of p-type or n-type can be fabricated depending on the manufacturing conditions; the image forming member is perfectly free from public pollution; it is excellent in its wear-resistant property due to its high surface hardness; it is also excellent in its developer-resistant property; and it is further excellent in its other electrophotographic properties such as cleaning Even with the a—Si:H type electrophotographic image forming member excellent in its electrophotographic characteristics in various points as mentioned above, there still exists room for improvement in respect of its light sensitivity in a practical light quantity region, its γ value, its dark resistivity, its heat-resistant property in a much higher temperature region than the temperature region of ordinary use at the time of conducting a process for improving its characteristics or adding other functions thereto, and its light response property, etc.

SUMMARY OF THE INVENTION

The present invention has been made in view of the above-mentioned various disadvantages inherent in the conventionally known electrophotographic image forming members, and it aims at providing an improved electrophotographic image forming member which has successfully solved these various problems.

It is another object of the present invention to provide an electrophotographic image forming member capable of reproducing a high quality reproduction image with clear half tone and high image resolution.

It is still another object of the present invention to provide an improved electrophotographic image forming member with further improved photosensitivity in a practical light quantity region, a γ value, and a dark resistivity.

It is yet another object of the present invention to provide an electrophotographic image forming member having excellent light-response property and heat-resistant property which enables the process for improving its characteristics or adding other functions to be effected thereto at a high temperature and in a stabilized state.

According to the present invention, in one aspect thereof, there is provided an electrophotographic image forming member comprising a substrate, and a photoconductive layer comprising an amorphous material containing therein silicon atom as the matrix and halogen atom as the constituent atom.

According to the present invention, in another aspect thereof, there is provided an electrophotographic image forming member having a substrate and a photoconductive layer, wherein the photoconductive layer has a first layer region comprising an amorphous material containing therein silicon atom as the matrix and halogen atom as the constituent atom, and a second layer region comprising an amorphous material containing silicon atom as the matrix, and a depletion layer is formed between the first and second layer regions.

DETAILED DESCRIPTION OF THE INVENTION

Figure 1:
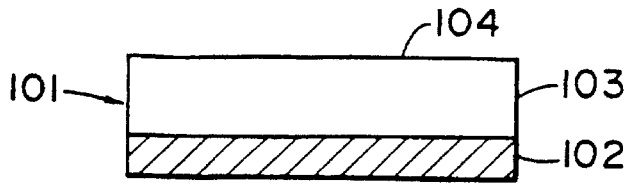
FIGS. 1 through 4 are schematic diagrams, each illustrating a preferred embodiment of the layer structure suitable for the electrophotographic image forming member according to the present invention.

Referring first to FIG. 1 showing the most representative layer structure of the electrophotographic image forming member according to the present invention, the electrophotographic image forming member 101 is constructed with a substrate 102 and a photoconductive layer 103. The photoconductive layer 103 has a free surface 104 to be an image forming plane, and is composed of an amorphous material containing therein silicon atom of the under-mentioned three types (1), (2) and (3) as the matrix and a halogen atom (hereinafter denoted as "X") as a constituent atom. Such amorphous silicon containing therein halogen will hereinafter be simply denoted as "a—Si:X".

When the photoconductive layer 103 is formed of a—Si:X as mentioned above, it can exhibit the γ value close to 1, increase its dark resistivity, become highly sensitive to light in the practical light quantity region, and acquire excellent light response property. As the result, there can be obtained the electrophotographic image forming member having far excellent electrophotographic characteristics in comparison with the conventional Se-type electrophotographic image forming member.

Further, since the photoconductive layer made of a—Si:X is structurally stable in a temperature region as high as several hundred degrees, it is also excellent in its heat-resistant property such that a process for improving its characteristics or adding thereto other functions or characteristics can be carried out in a high temperature region.

The three types of halogen-containing amorphous silicon are as follows:

(1) n-type a—Si:X . . . this contains donor alone, or both donor and acceptor with the donor concentration (Nd) being higher;

(2) p-type a—Si:X . . . this contains acceptor alone, or both donor and acceptor with the acceptor concentration (Na) being higher; and (3) i-type a—Si:X . . . this has a relationship of $Na \approx Nd \approx 0$ or $Na \approx Nd$.

For the halogen atom to be included in the photoconductive layer for use in the electrophotographic image forming member according to the present invention, there can be enumerated fluorine, chlorine, bromine, and iodine, of which fluorine and chlorine are particularly preferable.

The photoconductive layer of the abovementioned three types of a—Si:X according to the present invention can be formed by, for example, the glow discharge method, sputtering method, or ion-plating method, and other vacuum deposition methods utilizing the electric discharge phenomenon. For example, the a—Si:X type photoconductive layer can be formed by the glow discharge method through the steps of introducing into a deposition chamber capable of reducing its inner pressure a raw material gas for halogen introduction along with a raw material gas capable of producing silicon, then creating a glow discharge within the deposition chamber, and forming the a—Si:X on the surface of a substrate for the electrophotographic image forming member at a predetermined position in the chamber. In case the photoconductive layer is formed by the reactive sputtering method, the raw material gas for introducing halogen may be introduced into a sputtering deposition chamber when a target formed of silicon is to be sputtered in an atmosphere of, for example, argon (Ar), helium (He), neon (Ne) and other rare gases, or a mixture gas containing these rare gases as the basic component.

For the silicon producing raw material gas to be effectively used in the present invention, there may be enumerated various hydrogenated silicons (silanes) such as $SiH_4$, $Si_2H_6$, $Si_3H_8$, $Si_4H_{10}$, etc., which are in a gaseous state or capable of being readily gasified. Of these hydrogenated silicons, $SiH_4$ and $Si_2H_6$ are particularly suitable in respect of their facility in handling for preparing the layer, their high efficiency in the silicon production, and others.

Effective raw material gas for introducing halogen to be used in the present invention is selected from various halogen compounds such as, for example, halogen gases, halogenated substance, interhalogen compounds, all being in a gaseous state or being capable of readily gassified. In addition, those halogen-containing silicon compounds, which are capable of simultaneously producing silicon and halogen are in a gaseous or readily gassifiable state at a normal temperature and under a normal pressure, can be used as the effective material for the purpose of the present invention.

For the halogen compounds useful for the present invention, there may be enumerated halogen gas as fluorine, chlorine, bromine, or iodine; halogenated carbon compounds such as $CF_4$, $C_2F_6$, $C_3F_8$, $C_4F_8$, i-$C_4F_{10}$, $C_2F_4$, $CCl_4$, $CBr_4$, and so on; and interhalogen compounds such as BrF, ClF, $ClF_3$, $BrF_5$, $BrF_3$, $IF_7$, $IF_5$, ICl, IBr, and so on; and other compounds such as $F_2CO$, $(CF_3)_2O_2$, $(CF_3)_2CO$, $SF_4$, and $SF_6$.

Examples of the halogen-containing silicon compound are those halogenated silicons such as $SiF_4$, $Si_2F_6$, $SiCl_4$, $SiBr_4$, $SiCl_3Br$, $SiCl_2Br_2$, $SiClBr_3$, $SiCl_3I$, and so on. When the photoconductive layer characteristic of the present invention is to be formed by the glow discharge method utilizing such halogen-containing silicon compounds, the a—Si:X type photoconductive layer can be formed on a predetermined substrate without use of the hydrogenated silicon gas capable of producing silicon, as the raw material gas. In case the electrophotographic image forming member according to the present invention is manufactured by the glow discharge method, the a—Si:X layer can be formed on a predetermined substrate for the electrophotographic image forming member by introducing the hydrogenated silicon gas as the raw material for producing silicon and the halogen introducing compound gas into a deposition chamber for forming the a—Si:X type photoconductive layer in a predetermined mixing ratio and gas flow rate, and then creating the glow discharge to form a plasma atmosphere of these gases. In addition to these gases, there may further be admixed the halogen-containing silicon compound gas for the layer formation. Each of these gases may not only be used singly, but also be used in a mixture of a plurality of kinds at a predetermined mixing ratio.

In order to form the a—Si:X type photoconductive layer by the sputtering method or the ion-plating method, the following steps may be adopted: in the case of the sputtering method, a target made of silicon is used, which is sputtered in a predetermined gas plasma atmosphere; and, in the case of the ion-plating method, a polycrystalline or monocrystalline silicon is placed on an evaporating boat as a vapor source, and then the vapor source is subjected to heating and evaporation by a resistive heating method or an electron beam method (EB method), etc., the sputtering product as evaporated is caused to pass through the gas plasma atmosphere. For halogen to be introduced into the photoconductive layer to be formed in either of the sputtering method and ion-plating method, the abovementioned halogen compound or halogen-containing silicon compound in the gaseous state may be introduced into the deposition chamber to form a plasma atmosphere of the gas.

In the present invention, the abovementioned halogen compounds or halogen-containing silicon compounds are effectively used as the raw material gas for introducing halogen. Besides these compounds, there may further be enumerated, as the effective raw materials, halogenated hydrogen such as HF, HCl, HBr, HI, etc.; halogen-substituted hydrogenated silicons such as $SiH_2F_2$, $SiH_2Cl_2$, $SiHlC_3$, $SiH_2Br_2$, $SiHBr_3$, etc.; or halogen-substituted paraffin-type hydrocarbons such as $CHF_3$, $CH_2F_2$, $CH_3F$, $CH_3Cl$, $CH_3Br$, $CH_3I$, $C_2H_5Cl$, etc.; and other halogen compounds containing the hydrogen atom as one of the constituent atoms, all these compounds being in a gaseous state or being capable of readily gassified.

These hydrogen-containing halogen compounds can be used as the suitable raw material gas for introducing hydrogen, since they are capable of introducing hydrogen into the photocOnductive layer at its formation, and of simultaneously introducing thereinto other hydrogen which is extremely effective for controlling the electrical or photoelectric characteristics of the photoconductive layer.

For introducing hydrogen into the a—Si:X type photoconductive layer as a structural element thereof, there may be effected the following method besides the abovementioned. That is, hydrogen or those hydrogenated silicon gases such as $SiH_4$, $Si_2H_6$, $Si_3H_8$, $Si_4H_{10}$, etc. is placed in the deposition chamber together with silicon or silicon compounds for producing a—Si, followed by electric discharge. For instance, in the case of the reactive sputtering method, the a—Si:X type photoconductive layer with hydrogen having been introduced thereinto can be formed on a predetermined surface of the substrate for the electrophotographic image forming member by using a silicon target, introducing the halogen introducing raw material gas and hydrogen gas into the deposition chamber, together with a rare gas such as argon (Ar), etc. depending on necessity, to form the plasma atmosphere, and then sputtering the abovementioned silicon target.

According to the knowledge and discovery by the present inventors, it has been found out that the content of the halogen atom in the a—Si:X type photoconductive layer 3 constitutes one of large factors governing possibility of whether the a—Si:X layer as formed can be used as the photoconductive layer of the electrophotographic image forming member, or not, hence it is an extremely important factor.

In the present invention, the quantity of the halogen atom to be contained in the a—Si:X layer should desirably be from 1 to 40 atomic % in an ordinary case, or more preferably from 2 to 20 atomic %, in order that the a—Si:X layer is sufficiently applicable as the photoconductive layer for the electrophotographic image forming member. The theoretical ground for limiting the content of the halogen atom in the a—Si:X layer has yet to be clarified, hence it is still a matter of inference. It has however been recognized from many experimental results that, with the content of the halogen atom outside the abovementioned numerical range, its dark resistance is too low or its light sensitivity is extremely low, etc. as the photoconductive layer for the electrophotographic image forming member. Therefore, it is well supported that the abovementioned numerical range for the halogen atom content should be the essential requirement. Inclusion of the halogen atom in the layer to be formed can be done by using a starting substance to form a—Si selected from the halogenated silicons such as $SiF_4$, $Si_2F_6$, etc. in the case of the glow discharge method, wherein the starting substance decomposes to form the photoconductive layer, at which time the halogen atom is automatically introduced into the layer. In order, however, to effect inclusion of the halogen atom into the layer more efficiently, a halogen compound or a halogen-substituted hydrogenated silicon gas may be introduced into the system of the glow discharging device at the time of forming the photoconductive layer. In the case of using the sputtering method, it may be sufficient that either the abovementioned halogenated substance is introduced when the sputtering operation is conducted on silicon as a target in an atmosphere of the rare gas such as argon (Ar), etc. or a mixture gas with such rare gas as the basic component, or a halogen-substituted hydrogenated silicon gas or a halogenated compound gas such as $PCl_3$, $BCl_3$, $BBr_3$, $AsCl_5$, $BF_3$, $PF_3$, etc. which also serves as impurity dopant to be mentioned later. These halogenated compounds are capable of introducing halogen and impurity simultaneously, even in the glow discharge method, by introducing the same into the deposition chamber.

The content of hydrogen in the photoconductive layer to be formed is appropriately determined as desired so that the photoconductive layer of desired characteristics may be obtained in relation to the halogen content. Usually, the hydrogen content is so controlled that the total content of hydrogen and halogen may be within the numerical range of the abovementioned halogen content when it is used singly. Practically, it is usually two times or less than the halogen content, or preferably equal to, or less than, the halogen content, or optimumly 0.5 times or less than that. It is desirable that the total content of halogen and hydrogen should be 40 atomic % or less, or preferably 20 atomic % or less.

In order to control the quantity of the halogen atom to be contained in the a—Si:X type photoconductive layer to be formed to attain the purpose of the present invention, it may be sufficient that the following parameters be controlled: a temperature of the substrate, on which deposition is to be made; or a quantity of a starting material gas to be used for including the halogen atom to be introduced into the manufacturing device; or a plasma density; or a pressure within the manufacturing device, or all of these factors. Further, after formation of the photoconductive layer, it may be exposed to an activated. halogen atmosphere. The temperature of the substrate should desirably be from 100° to 550° C. in ordinary case, and more preferably from 200° to 500° C.

As the impurities to be doped in the a—Si:X type photoconductive layer to be formed, there may be enumerated as preferred examples thereof those elements of the Group III-A in the Periodic Table, e.g., By Al, Ga, In, Tl, etc. for obtaining the p-type layer, and those elements of the Group V-A in the Periodic Table, e.g., N, P, Ga, Sb, Bi, etc. for obtaining the n-type layer. Besides the above, it is also possible to form the n-type layer by doping lithium (Li) through heat diffusion or ion-implantation.

Quantity of the impurities to be doped in the a—Si:X photoconductive layer may be arbitrarily determined in accordance with electrical and optical characteristics of the photoconductive layer, as desired. In the case of the Group III-A impurities, it is usually from $10^{-6}$ to $10^{-3}$ atomic %, or more preferably from $10^{-5}$ to $10^{-4}$ atomic %. In the case of the Group V-A impurities, it usually ranges from $10^{-8}$ to $10^{-3}$ atomic %, or more preferably from $10^{-8}$ to $10^{-4}$ atomic %.

In the present invention, thickness of the photoconductive layer is arbitrarily determined to meet the desired purpose so that the function of the photoconductive layer may be effectively made use of, and the purpose of the present invention may be effectively attained. Actual figures for the layer thickness are usually from 1 to 70 microns, or more preferably from 2 to 50 microns.

In the image forming member as shown in FIG. 1, in which the photoconductive layer 103 has the free surface 104, and the charging process is effected on this free surface 104 for the electrostatic image formation, it is more preferable that a barrier layer having a function of inhibiting carrier injection from the side of the substrate 102 at the time of the charging process for the electrostatic image formation be provided between the photoconductive layer 103 and the substrate 102. For the material to form such barrier layer having the function of inhibiting the carrier injection from the substrate side, there may be selected and used any appropriate material in accordance with the kind of the substrate to be chosen and the electrical characteristics of the photo-conductive layer to be formed. Concrete examples of such barrier layer forming material are inorganic insulative compounds such as $Al_2O_3$, SiO, $SiO_2$, etc.; organic insulative compounds such as polyethylene, polycarbonate, polyurethane, polyparaxylylene, and so forth; and metals such as Au, Ir, Pt, Rh, Pd, Mo, etc.

The substrate 102 may be either electrically conductive or electrically insulative. Examples of the electrically conductive substrate are stainless steel, Al, Cr, Mo, Au, Ir, Nb, Te, V, Ti, Pt, Pd, and so forth, or alloys of these metals. Examples of the electrically insulative substrates are polyester, polyethylene, polycarbonate, cellulose triacetate, polypropylene, polyvinyl chloride, polyvinylidene chloride, polystyrene, polyamide, and other synthetic resins in the form of film or sheet. Besides these, there may usually be used glass, ceramics, paper, etc. It is desirable that these electrically insulative substrate be preferably subjected to electrically conductive treatment on at least one surface side thereof.

For example, in the case of glass, its surface is subjected to electrically conductive treatment with $In_2O_3$, $SnO_2$, Al, Au, etc., or, in the case of polyester film and other synthetic resin films, its surface is treated with Al, Ag, Pb, Zn, Ni, Au, Cr, Mo, Ir, Nb, Ta, V, Ti, Pt, and other metals by the vacuum evaporation method, the electron beam evaporation method, sputtering method, and so on. Or, the abovementioned metals are subjected to the lamination treatment to render the surface thereof to be electrically conductive. The shape of the substrate may be arbitrarily determined such as in a cylindrical shape, belt shape, planar shape, etc. It can be determined as desired. In the case of continuous, high speed reproduction, it is desirable that it be in an endless belt shape or cylindrical shape.

Thickness of the substrate may be arbitrarily determined so that the image forming member as desired may be formed. In case, however, the image forming member is required to have flexibility, it is made as thin as possible within such an extent that it sufficiently exhibits its function as the substrate. In such case, however, the thickness may usually be 10 microns and above from the standpoint of manufacturing and handling of the substrate as well as its mechanical strength, etc Although the electrophotographic image forming member 101 shown in FIG. 1 is of such construction that the a—Si:X photoconductive layer 103 has the free surface 104, it may also be feasible that a surface coating layer such as a protective layer, an electrically insulative layer, etc. be provided on the surface of the a—Si:X type photoconductive layer 103 as in certain kinds of conventional electrophotographic image forming member. The electrophotographic image forming member having such surface coating layer is shown in FIG. 2.

Figure 2:
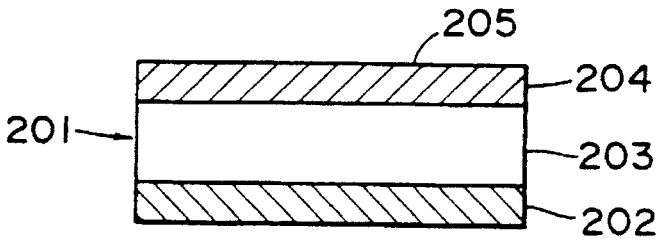

The electrophotographic image forming member 201 shown in FIG. 2 is not essentially different in structure from the electrophotographic image forming member 101 shown in FIG. 1 with the exception that the surface coating layer 204 is provided on the a—Si:X type photoconductive layer 203. The characteristics required of the surface coating layer 204, however, differs from one electrophotographic process to another to be adopted. For example, when the electrophotographic process such as the NP-process as taught in U.S. Pat. Nos. 3,666,363 and 3,734,609 is adopted, the surface coating layer 204 is required to be electrically insulative, have sufficient electrostatic charge sustaining capability when it is subjected to the charging process, and have thickness of a certain degree or more. However, when the electrophotographic process such as, for example, the Carlson process, is adopted, the electric potential at the bright portion of the image after formation of the electrostatic image should desirably be very small, hence thickness of the surface coating layer 204 is required to be very thin. The surface coating layer 204 is formed in consideration of its not giving chemical and physical mal-effects to the photoconductive layer 203, of its electrical contact property and adhesive property to the layer 204, and further of its moisture-resistant property, wear-resistant property, cleaning property, etc., in addition to its satisfying desired electrical characteristics.

Representative examples of the forming material for the surface coating layer 204 which can be used effectively are: polyethylene terephthalate, polycarbonate, polypropylene, polyvinyl chloride, polyvinylidene chloride, polyvinyl alcohol, polystyrene, polyamide, polytetrafluoroethylene, polytrifluoroethylene chloride, polyvinyl fluoride, polyvinylidene fluoride, copolymers of hexafluoropropylene and tetrafluoroethylene, copolymers of trifluoroethylene and vinylidene fluoride, polybutene, polyvinyl butyral, polyurethane, and other synthetic resins; and diacetate, triacetate, and other cellulose derivatives; and so forth. These synthetic resins or cellulose derivatives may be shaped into a film form and adhered onto the photoconductive layer 203, or they are rendered a liquid form to be coated on the photoconductive layer for the layer formation. Thickness of the surface coating layer 204 may be arbitrarily determined depending on the characteristics as desired, or the quality of the material to be used. Usually, it ranges from 0.5 to 70 microns or so.

Figure 3:
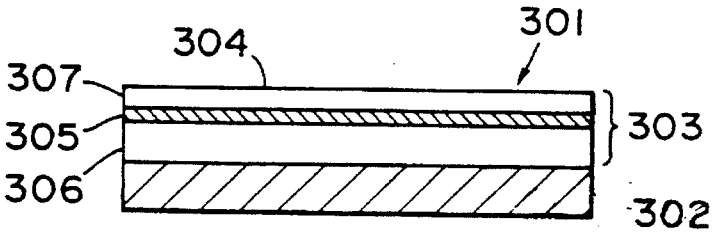

FIG. 3 shows a further representative construction of the electrophotographic image forming member according to the present invention, in which the electrophotographic image forming member 301 is composed of the substrate 302 and the photoconductive layer 303. The photoconductive layer 303 has the free surface 304 to constitute the image forming plane, and a region constructed with the a—Si:X, in which the depletion layer 305 is present.

Provision of the depletion layer 305 within the photoconductive layer 303 can be done by selecting two kinds of the abovementioned three types of a—Si:X (1) to (3), and then joining these two different types of a—Si:X in a layer form, thereby forming the photoconductive layer 303. In more detail, the depletion layer 305 can be formed, for example, by first forming the i-type a—Si:X layer on the substrate 302 having a desired surface characteristic to a predetermined layer thickness, and then forming the p-type a—Si:X layer on this i-type a—Si:X layer whereby the depletion layer is formed as a junction between the i-type a—Si:X layer and the p-type a—Si:X layer (the a—Si:X layer to the side of the substrate 302 with respect to the depletion layer 305 will hereinafter be called "inner layer", and the a—Si:X layer to the side of the free surface 304 will be called "outer layer"). That is to say, the depletion layer 305 is formed in a boundary transition region between the inner a—Si:X layer and the outer a—Si:X layer when the photoconductive layer 303 is formed in such a manner that these two different types of a—Si:X layer may be joined together.

The depletion layer 305 formed within the photoconductive layer 303 shown in FIG. 3 has a function of absorbing electromagnetic waves to be irradiated at the time of the electromagnetic wave irradiation process, which is one of the processes for forming the electrostatic image on the electrophotographic image forming member, to produce a mobile carrier. Further, since the depletion layer 305 is in a state of lacking in free carrier, in its ordinary state, it exhibits the so-called intrinsic semiconductor.

In the electrophotographic image forming member 301 shown in FIG. 3, both inner layer 306 and outer layer 307 constituting the photoconductive layer 303 are composed of the a—Si:X, the principal component of which, as the constituent element thereof, is silicon (Si), and the junction (the depletion layer 305) is a homo-junction. Therefore, the inner layer 306 and the outer layer 307 form a good electrical and optical junction, and the energy bands in both inner and outer layers are smoothly joined. Further, there exists in the depletion layer 305 a proper electric field (diffused potential)(inclination in the energy band) formed at the time of the layer formation. On account of this, not only the carrier producing efficiency becomes satisfactory, but also probability in recombination of the carrier thus produced decreases; in other words, there accrue such remarkable effects that the quantum efficiency increases, light response speed becomes fast, and generation of the residual charge is prevented, and so forth.

Accordingly, in the depletion layer 305 of the present invention, the carrier produced by irradiation of electromagnetic waves such as light effectively work to form the electrostatic image.

The electrophotographic image forming member shown in FIG. 3, for the purpose of more effectively using its characteristics, selects the charge polarity in such a manner that a voltage which constitutes a reverse bias may be applied to the depletion layer 305 formed in the photoconductive layer 303 at the time of forming the electrostatic image, and then it is subjected to the charging process on its outer layer surface.

According to the knowledge and finding of the present inventors, the content of the halogen atom in the inner layer or the outer layer has been found to be one of the large factors to govern applicability of the photoconductive member thus formed in its practical use to a satisfactory extent, hence it is an extremely important factor.

In the present invention, for the photoconductive member to be satisfactorily applicable in the practical aspect, the content of the halogen atom in the inner layer or the outer layer should desirably range from 1 to 40 atomic % in ordinary case, or more preferably from 2 to 20 atomic %.

When hydrogen is contained in the inner layer or the outer layer to be formed, the content of hydrogen should be appropriately determined so that desired characteristics may be obtained in relation to the halogen content. In the ordinary case, the hydrogen content is controlled within a numerical range such that the total content of hydrogen and halogen may be within the numerical range of the content of halogen alone. Practically, the hydrogen content should desirably be twice or less than the halogen content in ordinary case, or preferably equal to, or less than, the halogen content, or optimumly 0.5 times or less than that.

Although, in the foregoing explanations, there has been described an example, wherein the inner layer 306 and the outer layer 307 are constituted with the afore-mentioned three types of a—Si:X (1), (2) and (3), the present invention is not limited to such types of the layer, but it may be feasible that either. of the inner layer 306 or the outer layer 307 is constructed with any of the three types of a—Si:X, and the other is constructed with an a—Si:H of the following types (4), (5) and (6) which do not contain halogen atom as the constituent element.

(4) n-type a—Si:H . . . this contains a donor alone, or both donor and acceptor with concentration (Nd) of the donor being high;

(5) p-type a—Si: H . . . this contains an acceptor alone, or both donor and acceptor with concentration (Na) of the acceptor being high; and (6) i-type a—Si:H . . . this has a relationship of NaβNd≈0 or Na≈Nd.

The method of incorporating hydrogen into the layer to be formed can be realized by the following processes, i.e., at the time of forming the layers, it is introduced into a deposition device system in the form of a silicon compound such as $SiH_4$, $Si_2H_6$, $Si_3H_8$, $Si_4H_{10}$, and other silanes, after which these compounds are decomposed by pyrolysis, glow discharge, etc., thereby incorporating hydrogen into the layer along with its growth.

In the case of forming the a—Si:H type layer by the glow discharge method, hydrogenated silicon (silane) gas such as $SiH_4$, $Si_2H_6$, $Si_3H_8$, $Si_4H_{10}$, etc. are used as the starting substance to form the a—Si:H layer, hence hydrogen is automatically contained in the layer at the time when the hydrogenated silicon gas is decomposed to form the layer.

In the case of using the reactive sputtering method, hydrogen gas ($H_2$) , or hydrogenated silicon gas such as $SiH_4$, $Si_2H_6$ , $Si_3H_8$ , $Si_4H_{10}$, etc., or a gas such as $B_2H_6$ , $PH_3$ ,etc. serving also as the impurity dopant may be introduced, when silicon as a target is subjected to the sputtering operation in an atmosphere of an inert gas such as argon (Ar), etc. or a mixture gas consisting of the inert gas as the base.

For the electrophotographic image forming member of the layer structure as shown in FIG. 3 to be satisfactorily used in a practical aspect, the hydrogen content in the a—Si:H layer should desirably range from 1 to 40 atomic %, or more preferably from 5 to 30 atomic %.

In order to control the hydrogen content in the a—Si:H type layer, a quantity of the starting material to be introduced into the deposition device system used for incorporating hydrogen or a temperature of the substrate, on which the layer deposition is effected, be properly controlled. The layer which is either the inner layer 306 or the outer layer 307 and which is not at the side of the electromagnetic wave irradiation, in other words, the layer which is opposite to the electromagnetic wave irradiation side with respect to the depletion layer 305, has the function of effectively transporting the charge generated in the depletion layer 305, and, at the same time, can be formed as the layer (charge transporting layer) which greatly contributes to the electric capacitance of the photoconductive layer 303.

For this reason, the abovementioned layer having the charge transporting function should desirably be formed with a layer thickness range of from 0.5 to 100 microns in ordinary case, or preferably from 1 to 50 microns, or optimumly from 1 to 30 microns taking into consideration of economy including the manufacturing cost and the manufacturing time, etc. of the image forming member. Further, when the image forming member is required to have flexibility, it should desirably be formed with the layer thickness of 30 microns as its upper limit of the preferable range, although it may be related with the extent of flexibility of other layers and the substrate 302.

In regard to the abovedescribed embodiment shown in FIG. 3, with a view to demonstrating superiority of the photoconductive layer of the present invention to the conventional photoconductive layer, there have been made explanations on two preferred modes of execution according to the present invention: the one, wherein two different types of the a—Si:X layers are selected out of the three types (1) to (3) as the inner layer 306 and the outer layer 307, e.g., p- and n- and i-type, p- and n-type, and so on in combination, and then these two layers are joined together to form the photoconductive layer 303; and the other, wherein one of three types of the a—Si:X type layers (1) to (3), and one of three types of a—Si:H type layers (4) to (6) having a different polarity from that of the a—Si:X type layer are selected, and then these layers are joined together to form the photo-conductive layer 303, i.e., the layer 303 having therein one depletion layer 305. In addition to this, the following cases would also constitute preferred embodiments of the present invention: (1) a case, wherein the photoconductive layer is formed by selecting the a—Si:X layers from the types (1) to (3) in such a manner that the adjacent layers may be mutually different in type as, for example, p-i-n, n-i-p, and so forth from the side of the substrate 302, and then these three layers are joined together; and (2) a case, wherein the photoconductive layer is formed by constituting at least one layer in the three-layer structure with the a—Si:X layer and the remaining layers with the a—Si:H layer, then making the adjacent layers to have different polarity, and joining these three layers. In these two cases, there exist two depletion layers within the photoconductive layer.

In the above-described cases, since two depletion layers are provided and high electric field can be applied to each of them, it becomes possible to apply large electric field, hence high surface potential can be easily obtained.

Same as mentioned with respect to the case of the a—Si:X layer in three types of (1) to (3), the a—Si:H layers of the three types (4) to (6) as the layer for constructing the photoconductive layer of the electrophotographic image forming member according to the present invention can be formed by doping a controlled quantity of an n-type impurity (to render the a—Si:H layer to be the type (4)), or a p-type impurity (to render the a—Si:H layer to be the type (5)), or both n- and p-type impurities into the a—Si:H layer at the time of forming the layer by the glow discharge method or the reactive sputtering method.

For the impurities to be doped into the a—Si:H layer, there may be used the Group III-A elements such as, for example, B, Al, Ga, In, Tl, etc. in the case of forming the p-type layer; and the Group V-A elements such as, for example, N, P, As, Sb, Bi, etc. in the case of forming the n-type layer, as is the case with forming the a—Si:X layer.

Content of the impurity to be doped in the a—Si:H layer may be arbitrarily determined in accordance with the desired electrical and optical characteristics. In the case of the Group III-A impurity, it usually ranges from $10^{-6}$ to $10^{-3}$ atomic %, or more preferably from $10^{-5}$ to $10^{-4}$ atomic %. In the case of the Group V-A impurity, it usually ranges from $10^{-8}$ to $10^{-3}$ atomic %, or more preferably from $10^{-8}$ to $10^{-4}$ atomic %.

Of the inner layer 306 and the outer layer 307 in the electrophotographic image forming member 301 shown in FIG. 3, a layer to be formed as one which performs the function as the electric charge carrying layer as mentioned above should preferably be reduced in its impurity concentration either continuously or discontinuously in the direction of the layer thickness from the side of the depletion layer 305 with a view to improving the charge carrying efficiency when the layer is rendered to have either the n-type or p-type polarity by the impurity doping at its formation.

In such a case, it would be more preferable that, for example, the impurity concentration in the layer region which is far from the depletion layer 305 is reduced to a remarkable extent with respect to the impurity concentration in the vicinity of the depletion layer forming region, or that this layer region is rather made a non-doping region of the impurity.

Further, in the image forming member such as the electrophotographic image forming member shown in FIG. 3, wherein the photoconductive layer 303 has the free surface 304, and the charging treatment for the electrostatic image formation is effected on this free surface 304, it would be much more preferable that a barrier layer having the same function as that shown in FIG. 1 be provided between the photoconductive layer 303 and the substrate 302.

Figure 4:
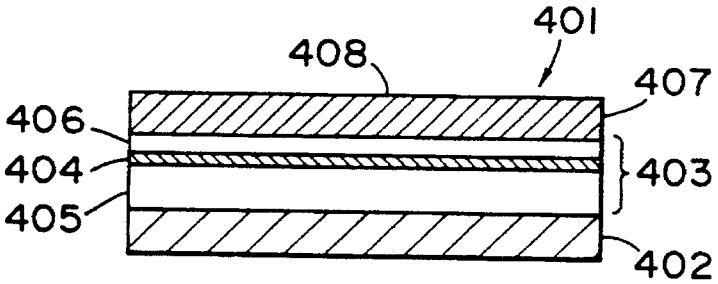

Although the image forming member 301 shown in FIG. 3 is of such construction that the photoconductive layer 303 has the free surface 304, it may also be feasible to provide a surface coating layer on the surface of the photoconductive layer 303 as already explained with reference to FIG. 2. FIG. 4 shows an image forming member having such surface coating layer.

The image forming member 401 in FIG. 4 is not essentially different in its construction from the image forming member 301 shown in FIG. 3 with the exception that the surface coating layer 407 having a free surface 408 is provided on the photoconductive layer 403 constructed with the depletion layer 404, the inner layer 405, and the outer layer 406, same as the photoconductive layer 303 in FIG. 3. The characteristics required of the surface coating layer 407, however, are variable depending on the electrophotographic process to be adopted as has been explained with reference to FIG. 2.

EXAMPLE 1

Figure 5:
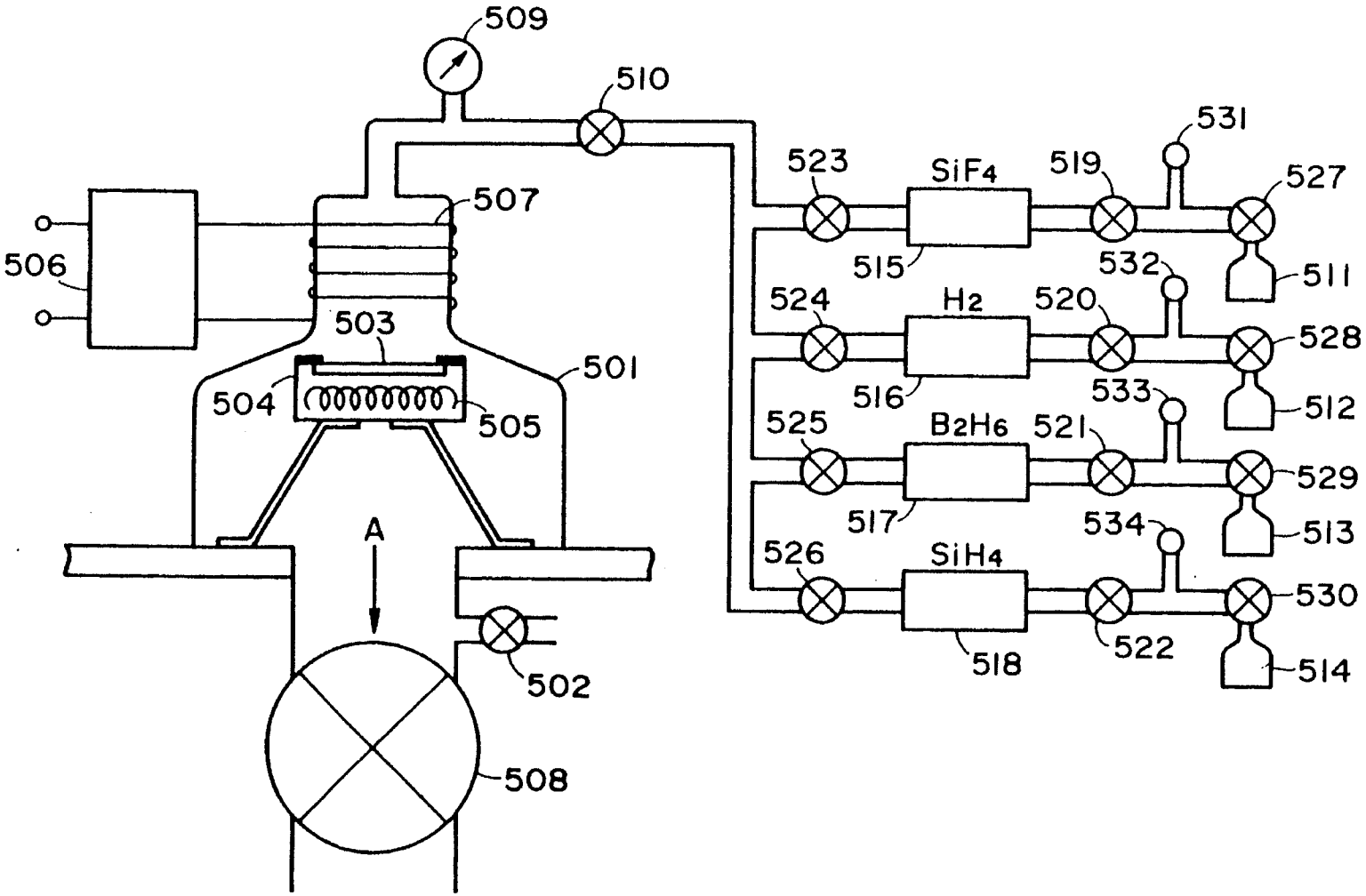
FIGS. 5 through 8 are schematic explanatory diagrams of preferred embodiments of the device for fabricating the electrophotographic image forming member according to the present invention.

An apparatus as shown in FIG. 5 was installed in a perfectly sealed clean room. Using this apparatus, the electrophotographic image forming member was fabricated by the operational steps as mentioned hereinbelow.

An aluminum plate (substrate) 503 of 0.2 mm in thickness and 5 cm in diameter with its surfaces cleaned was firmly fixed on a fixing member 504 at a predetermined position in a glow discharge deposition chamber 501 mounted on a supporting table 500. The substrate 503 was heated by a heater 505 provided in the fixing member 504 with precision of ±0.5° C. The temperature was directly measured from the back surface of the substrate by means of a thermocouple (alumel-chromel). After verifying that the all the valves in the system had been closed, the main valve 508 was made full open to discharge air from the deposition chamber 501 to render the vacuum degree therein to be approximately $5\times10^{-6}$ torr. Thereafter the input voltage to the heater 505 was raised until the temperature of the aluminum substrate attained a constant value of 300° C. the input voltage having been varied while detecting the substrate temperature in the course of the temperature rise.

After this, an auxiliary valve 510 was made full open, and subsequently flow-out valves 523, 524 and flow-in valves 519,520 were made full open. At the same time, flow meters 515,516 were also completely de-aerated in its interior to be brought to the, vacuum condition. After closure of the auxiliary valve 510, the flow-out valves 523, 524, and the flow-in valves 519,520, a valve 527 of a bomb 511 containing therein $SiF_4$ gas (99.999% purity) and a valve 528 of a bomb 512 containing therein hydrogen gas were opened. By regulating a pressure at respective outlet pressure gauges 531, 532 to 1 kg/cm$^2$, and gradually opening the flow-in valves 519,520, both $SiF_4$ gas and hydrogen gas were introduced into the flow meters 515 and 516, respectively. Subsequently, the flow-out valves 523, 524 were gradually opened, and then the auxiliary valve 510 was also opened. At this instant, the flow-in valves 519,520 were so adjusted that a ratio between the flow rate of $SiF_4$ gas and the flow rate of hydrogen gas may be 10:1. Next, opening of the auxiliary valve 510 was adjusted, while watching a Pirani gauge 509, until the deposition chamber 501 attained the vacuum degree of $1\times10^{-2}$ torr. Upon stabilization of the internal pressure of the. deposition chamber 501, the main valve 508 was gradually closed to be constricted until the Pirani gauge 509 indicated 0.5 torr. Verifying that the internal pressure of the deposition chamber 501 has become stabilized, and subsequently closing a switch for a high frequency power source 506, a high frequency power of 13.56 MHz was supplied to an induction coil 507 (on the upper part of the chamber) to generate glow discharge within the deposition chamber 501 at the coil portion, thereby obtaining an. input power of 10 W. Under the afore-described conditions, an amorphous semiconductor (hereinafter abbreviated as "a-semiconductor") layer was grown on the substrate to form the photoconductive layer. After maintaining the same conditions for eight hours, the high frequency power source 506 was opened to cease the glow discharging. Subsequently, a power source for the heater 505 was opened. As soon as the substrate temperature indicated 100° C. the auxiliary valve 510 and the flow-out valves 523, 524 were closed, while the main valve 508 was made full open to render the interior of the deposition chamber 501 to be $10^{-5}$ torr or below. After this, the main valve 508 was closed and the interior of the chamber 501 was rendered atmospheric by opening a leak valve 502, and the substrate was taken out. In this case, the total thickness of the a-semiconductor layer thus formed was approximately 16 microns. The thus obtained image forming member was placed in an experimental device for charging and exposing to be subjected to a negative corona charging at −5.5 KV for 0.2 sec. immediately followed by irradiation of a light image. The light image was irradiated by a tungsten lamp as the light source with a light quantity of 6 lux.sec. through a transmitting type test chart.

Immediately thereafter, a positively charged developer (containing a toner and a carrier) was cascaded on the surface of the image forming member, thereby obtaining a good toner image thereon. When the toner image on the image forming member was transferred onto an image transfer paper with a positive corona charge of +5 KV, there could be obtained a clear image with high image density, excellent image resolution, and good reproducibility of gradation.

EXAMPLE 2

Under and following the same conditions and procedures as in Example 1 above, the a-semiconductor layer (photoconductive layer) of 15 microns thick was formed on the aluminum substrate. Thereafter, the substrate with the photoconductive layer formed thereon was taken outside of the deposition chamber 501, and polycarbonate resin was coated on the a-semiconductor layer in such a manner that its thickness may be 15 microns after drying, thereby forming the electrically insulative layer. Thus, the electrophotographic image forming member was produced. When a positive corona discharge was effected as the primary charging on the surface of the insulative layer of this image forming member for 0.2 second with a power source voltage of 6,000 V, it was positively charged to +2,000 V. Next, a negative corona discharge was effected as the secondary charging thereon with a source voltage of 5,500 V simultaneously with an image exposure with an exposure light quantity of 5 lux. sec., followed by overall uniform irradiation of the surface of the image forming member, whereby an electrostatic image was formed. This electrostatic image was developed with a negatively charged toner by the cascade method, and then the developed image was transferred and fixed onto an image transfer paper, whereby a reproduced image of good quality was obtained.

EXAMPLE 3

In the same manner as in Example 1 above, the aluminum substrate was placed in the glow discharge deposition chamber 501, and then the interior of the deposition chamber was evacuated to a vacuum degree of $5\times10^{-6}$ torr. While maintaining the substrate at a temperature of 300° C. $SiF_4$ gas and hydrogen gas (ratio of the flow rate of $SiF_4$ to hydrogen being $10^{-1}$ vol %) were introduced into the deposition chamber, and the internal pressure of the chamber was adjusted to 0.5 torr. At this instant, there was further introduced into the deposition chamber $B_2H_6$ gas, in mixture with $SiF_4$ gas and hydrogen gas, in an amount of $1.5\times10^{-3}$ vol % with respect to $SiF_4$ gas. This introduction of $B_2H_6$ gas was effected from a $B_2H_6$ gas bomb 513 through the valve 529 at a gas pressure of 1 kg/cm$^2$ (a reading at the outlet pressure gauge 533) by adjustment of the flow-in valve 521 and the flow-out valve 525 through a reading at the flow meter 517. After the in-flow gas became stabilized, the internal pressure of the chamber became constant, and the substrate temperature became stabilized at 300° C., the high frequency power source 506 was turned on, same as in Example 1 above, to start the glow discharging. The glow discharging was continued for six hours under this condition, after which the high frequency power source 506 was turned off to stop the glow discharging. After this, the flow-out valves 523, 524, 525 were closed, and the auxiliary valve 510 and the main valve 508 were made full open to bring the internal pressure of the deposition chamber 501 to $10^{-1}$ torr or below. Then, the main valve 508 was closed and the deposition chamber interior 501 was rendered atmospheric by opening the leak valve 502, followed by removal of the substrate from the deposition chamber, whereby the image forming member was obtained. Thickness of the entire photoconductive layer thus formed was approximately 15 microns.

When the thus obtained image forming member was placed in the experimental device for charging and exposing, same as in Example 1 above, for the image forming test, a toner image of extremely favorable quality having high image contrast could be obtained in the image transfer paper in the case of combination of the negative corona discharge of −5.5 KV and the positively charged developer.

In the next place, the abovementioned electrophotographic image forming member was subjected to a positive corona discharging in the dark with a source voltage of 6,000 V, followed by image exposure with an exposure light quantity of 6 lux. sec., thereby forming an electrostatic image. When this electrostatic image was developed with a negatively charged toner by the cascade method followed by transfer and fixation of the developed image on the image transfer paper, there could be obtained very clear reproduced images.

It was found out from the result as well as the previous results that the electrophotographic image forming member obtained from this example had no dependency on the charge polarity, and has the characteristics of the image forming member having both polarity.

EXAMPLE 4

In exactly same manner as in Example 3 above, the photoconductive layer of 15 microns thick was formed on the aluminum substrate to manufacture the electrophotographic image forming member with the exception that the flow rate of $B_2H_6$ gas was adjusted to be $1.0\times10^{-2}$ vol % with respect to the flow rate of $SiF_4$ gas.

When this electrophotographic image forming member was subjected to the image formation on the image transfer paper under and following the same conditions and procedures as in Example 3, it was discovered that the image formed by effecting the positive corona discharge was superior in its image quality to the image formed by effecting the negative corona discharge, and the resulted reproduced image was extremely clear.

From the above results, it could be recognized that the electrophotographic image forming member obtained by this example had dependency on the charge polarity, although the polarity dependency was opposite to that obtained in Example 1 above.

EXAMPLE 5

Under and following the exactly same conditions and procedures as in Example 1 above, the electrophotographic image forming members identified as Specimen Nos. 1 to 8 were produced with the exception that the substrate temperature was varied as shown in the following Table 1. When the image was formed on the image transfer paper under the exactly same image forming conditions as in Example 3 above, the results as shown in the following Table 1 were obtained.

As seen from the results in Table 1 below, for attaining the purpose of the present invention in this particular example, the a—Si:X layer is required to be formed at the substrate temperature ranging from 100° to 550° C.

TABLE 1

| Specimen No. | | | 1 | 2 | 3 | 4 | 5 | 6 | 7 | 8 |
|---|---|---|---|---|---|---|---|---|---|---|
| Substrate Temp (°C.) | | | 50 | 100 | 200 | 300 | 400 | 500 | 550 | 600 |
| Quality of Transferred Image | Charge Polarity | (+) | x | Δ | Δ | Δ | x | x | x | x |
| | | (−) | x | Δ | ○ | ⊙ | ⊙ | ○ | Δ | x |

NOTE:
⊙ . . . Excellent
○ . . . Good
Δ . . . Practically useful
x . . . Poor

EXAMPLE 6

Under and following the exactly same conditions and procedures as in Example 1 above, the electrophotographic image forming members identified as Specimen Nos. 9 to 16 were produced with the exception that the substrate temperature was varied as shown in the following Table 2. When the image was formed on the image transfer paper under the exactly same image forming conditions as in Example 3 above, the results as shown in the following Table 2 were obtained.

As seen from the results shown in Table 2 below, for attaining the purpose of the present invention in this particular example, the a—Si:X layer is required to be formed at the substrate temperature ranging from 100° to 550° C.

TABLE 2

| Specimen No. | | | 9 | 10 | 11 | 12 | 13 | 14 | 15 | 16 |
|---|---|---|---|---|---|---|---|---|---|---|
| Substrate Temp (°C.) | | | 50 | 100 | 200 | 300 | 400 | 500 | 550 | 600 |
| Quality of Transferred Image | Charge Polarity | (+) | x | Δ | ○ | ◎ | ◎ | ○ | Δ | x |
| | | (−) | x | Δ | ○ | ◎ | ◎ | ○ | Δ | x |

NOTE:
◎ . . . Excellent
○ . . . Good
Δ . . . Practically useful
x . . . Poor

EXAMPLE 7

Under and following the exactly same conditions and procedures as in Example 1 above, the electrophotographic image forming members identified as Specimen Nos. 17 to 24 were produced with the exception that the substrate temperature was varied as shown in the following Table 3. When the image was formed on the image transfer paper under the exactly same image forming conditions as in Example 3 above, the results as shown in the following Table 3 were obtained.

As seen from the results shown in Table 3 below, for attaining the purpose of the present invention in this particular example, the a—Si:X layer is required to be formed at the substrate temperature ranging from 100° to 550° C.

TABLE 3

| Specimen No. | | | 17 | 10 | 19 | 20 | 21 | 22 | 23 | 24 |
|---|---|---|---|---|---|---|---|---|---|---|
| Substrate Temp (°C.) | | | 50 | 100 | 200 | 300 | 400 | 500 | 550 | 600 |
| Quality of Transferred Image | Charge Polarity | (+) | x | Δ | ○ | ◎ | ◎ | ○ | Δ | x |
| | | (−) | x | x | Δ | Δ | x | x | x | x |

NOTE:
◎ . . . Excellent
○ . . . Good
Δ . . . Practically useful
x . . . Poor

EXAMPLE 8

Under the exactly same conditions as in Example 3 above, the electrophotographic image forming member as identified by Specimens Nos. 25 to 30 were produced with the exception that the flow rate of $B_2H_6$ gas in Example 3 was varied with respect to the flow rate of $SiF_4$ gas so as to control the boron (B) content to be doped in the a—Si:X layer to be formed to various numerical values as shown in Table 4 below.

Using these electrophotographic image forming members, the image formation was performed on the image transfer paper under the same image forming conditions as in Example 3, whereupon the results as shown in Table 4 were obtained. As is apparent. from these results, the electrophotographic image forming member suitable for practical purposes should desirably contain boron doped in the a—Si:X layer in a quantity of from $10^{-6}$ to 10 atomic %.

TABLE 4

| Specimen No. | 25 | 26 | 27 | 28 | 29 | 30 |
|---|---|---|---|---|---|---|
| Doping Quantity of Boron (atomic %) | $1 \times 10^{-6}$ | $5 \times 10^{-6}$ | $1 \times 10^{-5}$ | $5 \times 10^{-5}$ | $1 \times 10^{-4}$ | $5 \times 10^{-4}$ |
| Quality of Transferred Image | ○ | ⊙ | ⊙ | ○ | Δ | x |

NOTE:
⊙ . . . Excellent (An excellent image can be obtained from both positive and negative charging.)
○ . . . Good (A more excellent image can be obtained from charging in either polarity, and a practically useful image can be obtained from charging from both negative and positive polarity.)
Δ . . . Poor (An image of practical use can be obtained from charging in either polarity alone.)
x . . . Unacceptable

EXAMPLE 9

Figure 6:
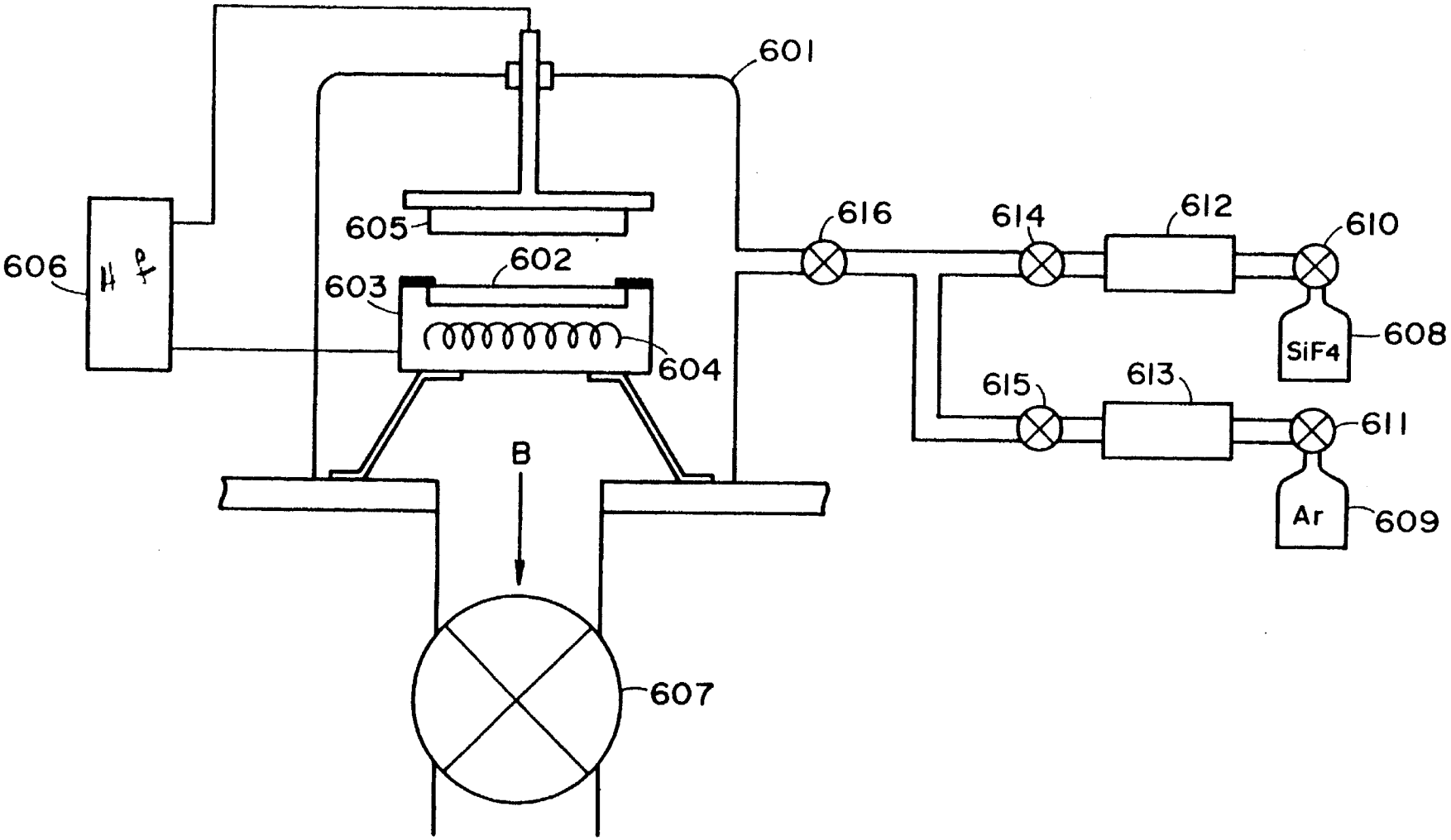

Using the device shown in FIG. 6, the electrophotographic image forming member according to the present invention was manufactured in the manner to be mentioned hereinbelow, and the thus obtained image forming member was subjected to the image forming process to obtain a reproduced image.

A substrate was prepared by vapor-deposition of molybdenum (Mo) to a thickness of approximately 1,000 Å on an aluminum plate having a dimension of 10 cm×10 cm and a thickness of 1 mm with its surface having been cleaned. This substrate 602 was firmly fixed at a predetermined position on the fixing member 603 mounted at a predetermined position in the deposition chamber 601 with the same being separated from the heater 604 at a space interval of 1.0 cm or so. The substrate was also separated for about 8.5 cm from a polycrystalline, sintered silicon target 605 (99.999% of purity).

Subsequently, interior of the deposition chamber 601 was evacuated by full-opening of the main valve 607 to make the vacuum degree therein at about $1\times10^{-6}$ torr. Thereafter, the heater 604 was ignited to uniformly heat the substrate to raise its temperature to 250° C., at which temperature the substrate was maintained. Then, a valve 616 was made full open, and a valve 610 of a bomb 608 was also made full open. After this, a flow rate adjusting valve 614 was gradually opened, and., while adjusting the main valve 607, $SiF_4$ gas was introduced into the deposition chamber 601 in a manner to render the vacuum degree therein to be $5.5\times10^{-5}$ torr.

After a valve 611 was made full open, the flow rate adjusting valve 615 was gradually opened, while watching the flow meter 613, to render the vacuum degree in the deposition chamber 601 to become $1\times10^{-3}$ torr, after which argon gas was introduced thereinto.

Following this, a switch for the high frequency power source 606 was turned on to apply a high frequency voltage of 1 kV and 13.56 MHz between the aluminum substrate and the polycrystalline silicon target to cause electric discharge, thereby commencing formation of the photoconductive layer onto the aluminum substrate. The layer formation was conducted for consecutive 30 hours. As the result, the photoconductive layer thus formed had its layer thickness of 20 microns.

The thus formed electrophotographic image forming member according to the present invention was then subjected to the negative corona discharge at the score voltage of 5,500 V in the dark, followed by the image exposure with a light quantity f 8 lux.sec., thereby forming a electronstatic image. This electrostatic image was developed with a positively developed toner image was transferred onto an image transfer paper, and fixed, whereupon a good reproduced image of sufficient clarity could be obtained.

EXAMPLE 10

Under the exactly same conditions as in Example 9 above, the electrophotographic image forming members as identified by Specimens Nos. 31 to 39 were manufactured with the exception that the flow rate of $SiF_4$ gas in Example 9 was varied with respect to the flow rate of argon gas so as to control the fluorine (F) content in the photoconductive layer to be formed to various numerical values as shown in Table 5 below.

Using theses electrophotographic image forming members the image formation was preformed on the image transfer paper under the same image forming conditions as in Example 9, whereupon the results as shown in Table 5 could be obtained. As is apparent from these results, the electrophotographic image forming member suitable for practical purposes should desirably contain fluorine in the layer in a quantity of from 1 to 40 atomic %.

TABLE 5

| Specimen No. | 31 | 32 | 33 | 34 | 35 | 36 | 37 | 38 | 39 |
|---|---|---|---|---|---|---|---|---|---|
| Content of Fluorine (atomic %) | 0.5 | 1.0 | 2.0 | 4.0 | 8.0 | 16.0 | 32.0 | 40 | 45 |
| Quality of Transferred Image | x | Δ | ○ | ⊙ | ⊙ | ⊙ | ○ | Δ | x |

NOTE:
⊙ . . . Excellent
○ . . . Good
Δ . . . Practically usable
x . . . Unacceptable

EXAMPLE 11

The electrophotographic image forming members manufactured in Examples 1, 3 and 4 were left in a high temperature, high humidity atmosphere of 50° C. and 90 RH %. After 96 hours' lapse, these specimens were taken out into an atmosphere of 23° C. and 50 RH%, and immediately subjected to the image formation on the image transfer paper under the same conditions and following the same procedures as in each of these Examples for each of the image forming members. A clear image of good quality was obtained. From this result, it was verified that the electrophotographic image forming member according to the present invention was also excellent in its moisture-resistant property.

EXAMPLE 12

The electrophotographic image forming members manufactured in Examples 1, 3, 4, 9 and 10 were heat-treated for 96 hours in an atmosphere of 400° C. and 75 RH %. Thereafter, the specimens were taken out into an atmosphere of 23° C. and 50 RH %. Upon each of the specimens having been cooled down to 23° C. it was subjected to the image formation on the image transfer paper under the same conditions and following the same procedures as in each of these Examples. As the results, there was obtained a clear image of good quality which was not different from that obtained without heat-treatment. From this result, it was verified that the electrophotographic image forming member according to the present invention was also excellent in respect of its heat-resistant property.

EXAMPLE 13

The image forming member produced in Example 1 above was subjected to latent image formation and development with a positively charged toner under the same process conditions as in Example 1 above. Thereafter, an image transfer paper was placed on the developed surface, and an image transfer roller, which had been applied with a voltage of −1,000 V and heated to 250° C., was urged onto the back surface of the paper and rotated. After this, the image transfer paper was peeled off from the image forming member. It was found that the toner on the image transfer paper was fixed to the paper to a satisfactory degree.

Using again this same image forming member, the latent image formation, development, and image transfer by the heating and transferring roller were repeated for 50,000 times. It was found that images of the substantially same image quality as that obtained at the initial could be obtained.

From this result, it was discovered that the heating and transferring roller capable of simultaneously effecting the image transfer and image fixation can be used in a reproduction apparatus having the electrophotographic image forming member of the present invention incorporated therein, whereby the reproduction apparatus per se can be simplified in construction, and low power consumption in such apparatus can be realized.

EXAMPLE 14

The electrophotographic image forming member manufactured in the same manner as in Example 1 above was subjected to a negative corona discharge in the dark with a source voltage of 5.5 KV, followed by image exposure with an exposure light quantity of 6 lux.sec., thereby forming an electrostatic latent image. This electrostatic image was developed with use of a liquid developer prepared by dispersing a charged toner in an isoparaffinic type hydrocarbon solvent, after which the developed image was transferred onto an image transfer paper, and fixed. The image which was thus obtained on the image transfer paper was extremely clear and high in its image resolution, and had high image quality.

Further, with a view to testing the solvent-resistant property (liquid developer resistant property) of the above-mentioned electrophotographic image forming member, the afore-described image forming process was repeatedly conducted, and the initially obtained image on an image transfer paper was compared with the image on the 10,000th of the image transfer sheet. It was verified that no difference whatsoever could be observed between them, and that the electrophotographic image forming member of the present invention was superior in its solvent-resistant property. For the cleaning method of the image forming member, there was adopted the blade cleaning method, for which purpose a blade shaped from urethane rubber was used.

EXAMPLE 15

Using the glow discharge deposition device shown in FIG. 5, the electrophotographic image forming member was fabricated in the undermentioned manner, and the thus obtained image forming member was subjected to the image forming process, followed by the image development.

At first, the aluminum plate (substrate) 503 of 0.2 mm in thickness and 5 cm in diameter, which had been cleaned by the same surface-treatment as in Example 1 above, was firmly fixed on the fixing member 504 mounted at a predetermined position in the glow discharge deposition chamber 501. After verifying that the entire valves in the system were closed, the main valve 508 was made full open to discharge air within the chamber 501 to bring its interior to the vacuum degree of approximately $5\times10^{-6}$ torr. Thereafter, an input voltage to the heater 505 was increased to heat the substrate to a stabilized constant value of 200° C. by varying the input voltage, while detecting the temperature of the aluminum substrate.

Then, the auxiliary valve 510, the flow-out valves 523, 526, and the flow-in valves 519, 522 were sequentially made full open, whereby the interior of the flow meters 515, 518 was sufficiently de-aerated and rendered vacuum. After the auxiliary valve 510, the flow-out valves 523, 526, and the flow-in valves 519, 522 were closed, the valve 527 of the bomb 511 containing therein $SiF_4$ gas (99.999% purity) and the valve 530 of the bomb 514 containing therein $SiH_4$ gas were opened. Then, by adjusting a pressure in each of the outlet pressure gauge 531, 534 to 1 kg/cm$^2$, and gradually opening the flow-in valves 519, 522, $SiF_4$ gas and $SiH_4$ gas were caused to flow into the flow meters 515, 518. Successively, the flow-out valves 523, 526, and then the auxiliary valve 510 were gradually opened. At this instant, the flow-in valves 519, 522 were so adjusted that a ratio between the flow rate of $SiF_4$ gas and the flow rate of $SiH_4$ gas could become 4:6. Following this, the opening of the auxiliary valve 510 was adjusted, while watching the indication on the Pirani gauge 509, until the vacuum degree in the chamber 501 became $1\times10^{-2}$ torr. As soon as the internal pressure of the chamber 501 became stabilized, the main valve 508 was gradually closed to constrict the opening until the Pirani gauge 509 indicated a value of 0.7 torr. Subsequently, by closing the switch for the high frequency power source 506, a high frequency power of 13.56 MHz was applied to the induction coil 507 (on the upper part of the chamber) to generate glow discharge within the deposition chamber 501, thereby obtaining an input power of 25 W. Under the afore-described conditions, a-semiconductor layer was grown on the substrate to form the photoconductive layer. After maintaining the same conditions for eight hours, the high frequency power source 506 was opened to cease the glow discharging. Subsequently, a power source for the heater 505 was opened. As soon as the substrate temperature indicated 100° C., the auxiliary valve 510 and the flow-out valves 523, 526 were closed, while the main valve 508 was made full open, to render the internal vacuum of the deposition chamber 501 to be $10^{-5}$ torr or below. After this, the main valve 508 was closed and the interior of the chamber 501 was rendered atmospheric by opening the leak valve 502, and then the substrate was taken out. In this case, the total thickness of the a-semiconductor thus formed was approximately 20 microns. The thus obtained image forming member was placed in the experimental device for charging and exposing, and subjected to a negative corona charging at −6 KV for 0.2 sec. immediately followed by irradiation of a light image. The light image was irradiated by a tungsten lamp as the light source with a light quantity of 7 lux-sec. through a transmitting type test chart.

Thereafter, a positively charged developer (containing a toner and a carrier) was cascaded on the surface of the image forming member, thereby obtaining a good toner image thereon. When the toner image on the image forming member was transferred onto an image transfer paper with a negative corona charge of −5 KV, there could be obtained a clear image of high density, excellent image resolution, and good reproducibility of gradation.

EXAMPLE 16

The a-semiconductor layer was grown on the substrate following and under the same processes and conditions as in Example 15 above with the exception that the temperature of the aluminum substrate was made 500° C.

When the thus obtained image forming member was subjected to the image development test under the same conditions as in Example 15 above, there could be obtained a clear image of excellent image resolution, good reproducibility in gradation, and high image density.

EXAMPLE 17

Figure 7:
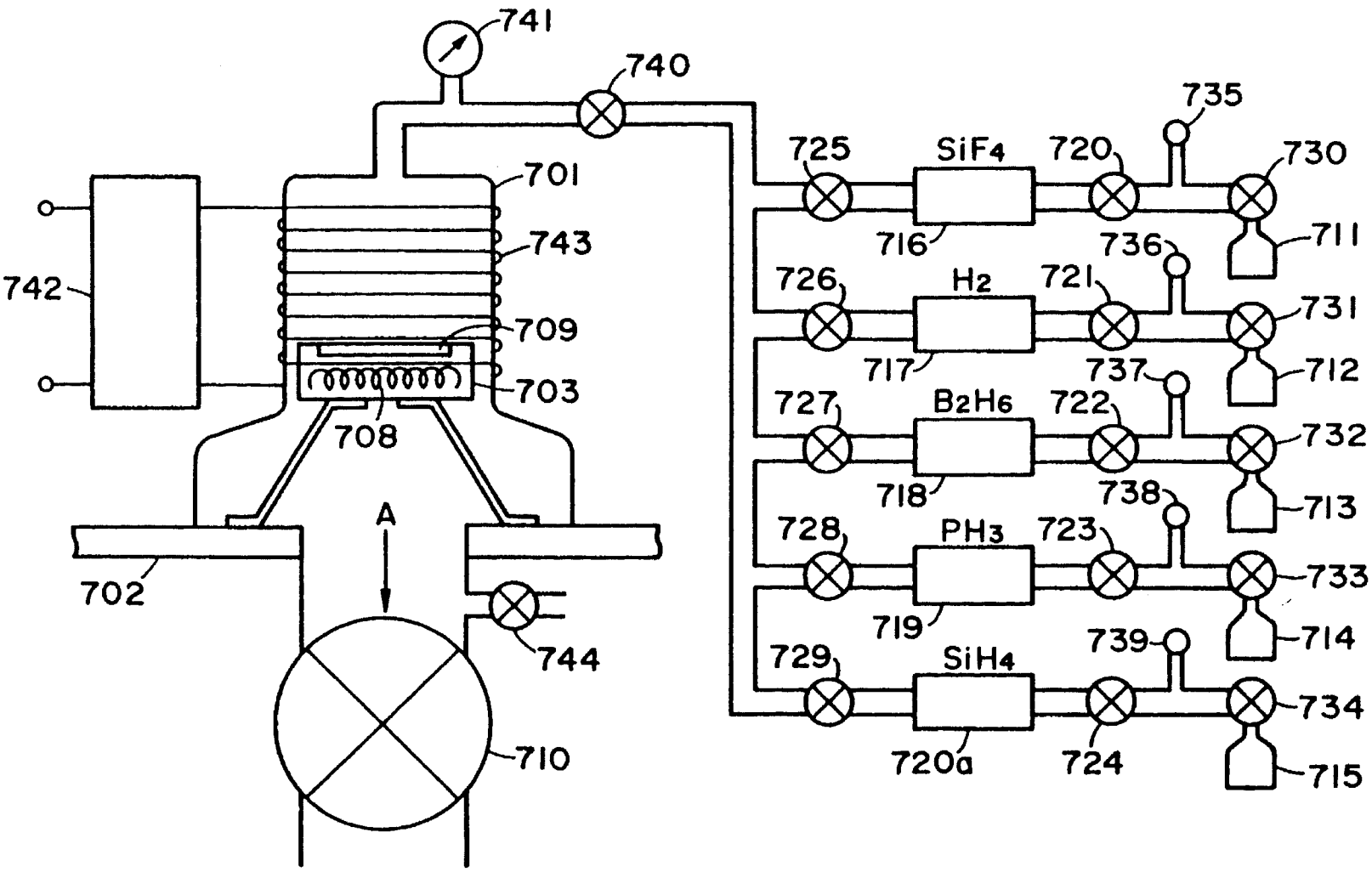

An apparatus as shown in FIG. 7 was installed in a perfectly sealed clean room. Using this apparatus, the electrophotographic image forming member was fabricated by the operational steps as mentioned hereinbelow.

A molybdenum plate (substrate) 709 of 0.2 mm in thickness and 5 cm in diameter with its surface cleaned was firmly fixed on a fixing member 703 at a predetermined position in a glow discharge deposition chamber 701 mounted on a supporting table 702. The substrate 709 was heated by a heater 708 provided in the fixing member 703 with precision of ±0.5° C. The temperature was directly measured from the back surface of the substrate by means of a thermocouple (alumel-chromel). After verifying that the entire valves in the system had been closed, the main valve 710 was made full open to discharge air from the deposition chamber 701 to render the vacuum degree therein to be approximately $5\times10^{-6}$ torr. Thereafter the input voltage of the heater 708 was raised until the temperature of the molybdenum substrate attained a constant value of 300° C., the input voltage having been varied while detecting the substrate temperature in the course of the temperature rise.

After this, an auxiliary valve 740 was made full open, and subsequently flow-out valves 725, 726, 727 and flow-in valves 720, 721, 722 were made full open. At the same time, flow meters 716, 717, 718 were also completely de-aerated in its interior to be brought to the vacuum condition. After closure of the auxiliary valve 740, the flow-out valves 725, 726, 727, and the flow-in valves 720, 721, 722, a valve 730 of a bomb 711 containing therein $SiF_4$ gas (99.999% purity) and a valve 731 of a bomb 712 containing therein hydrogen gas were opened. By regulating a pressure at respective outlet pressure gauges 735, 736 to 1 kg/cm$^2$, and gradually opening the flow-in valves 720, 721, both $SiF_4$ gas and hydrogen gas were caused to flow into the flow meters 716 and 717, respectively. Subsequently, the flow-out valves 725, 726 were gradually opened, and then the auxiliary valve 740 was also opened. At this instant, the flow-in valves 720, 721 were so adjusted that a ratio between the flow rate of $SiF_4$ gas and the flow rate of hydrogen gas may be 10:1. Next, opening of the auxiliary valve 740 was adjusted, while monitoring a Pirani gauge 741, until the deposition chamber 701 attained the vacuum degree of $1\times10^{-2}$ torr. Upon stabilization of the internal pressure of the deposition chamber 701, the main valve 710 was gradually closed to be constricted until the Pirani gauge 741 indicated 0.5 torr. Verifying that the internal pressure of the deposition chamber 701 had become stabilized, and subsequently closing a switch for a high frequency power source 742, a high frequency power of 13.56 MHz was applied to an induction coil 743 (on the upper part of the chamber) to generate glow discharge within the deposition chamber 701 at the coil portion, thereby obtaining an input power of 10 W. Under the afore-described conditions, the a-semiconductor layer was grown on the substrate to form the photoconductive layer. After maintaining the same conditions for three hours, the high frequency power source 742 was opened to cease the glow discharging. In this state, a valve 732 of a bomb containing therein $B_2H_6$ gas (99.999% purity) was opened, and, by adjusting a pressure in an outlet pressure gauge 737 to 1 kg/cm$^2$ and gradually opening the flow-in valve 722, $B_2H_6$ gas was caused to flow into the flow meter 718. After this, the flow-out valve 727 was gradually opened, and the opening of a flow-out valve 728 was controlled in such a manner that reading of the flow meter 718 could stably indicate the $SiF_4$ gas flow rate of 0.006 vol %.

Subsequently, the high frequency power source 742 was again turned on to resume the glow discharge. After continuing the glow discharging for further eight minutes, the heater 708 was turned off, and the high frequency power source 742 was also brought to its off state. As soon as the substrate temperature indicated 100° C., the flow-out valves 725, 726, 727 and the flow-in valves 720, 721, 722 were closed, while opening the main valve 710, to render the internal vacuum degree of the deposition chamber 701 to be $10^{-5}$ torr or below. After this, the main valve 710 was closed and the interior of the chamber 701 was rendered atmospheric by opening a leak valve 744, and the substrate was taken out. In this case, the total thickness of the a—Si:X layer thus formed was approximately 6 microns. The thus obtained image forming member was placed in an experimental device for charging and exposing, and subjected to a negative corona charging of −5.5 KV for 0.2 sec., immediately followed by irradiation of a light image. The light image was irradiated by a tungsten lamp as the light source with a light quantity of 5 lux.sec. through a transmitting type test chart.

Thereafter, a positively charged developer (containing a toner and a carrier) was cascaded on the surface of the image forming member, thereby obtaining a good toner image thereon. When the toner image on the image forming member was transferred onto an image transfer paper with a negative corona charge of −5 KV, there could be obtained a clear image of high density, excellent image resolution, and good reproducibility of gradation.

On the other hand, a positive corona charging of +6 KV was conducted on the image forming member. After the image exposure under the same condition as above, the image development was carried out with a positively charged developer. The obtained image was indistinct and low in its image density in comparison with the above results.

EXAMPLE 18

In the same manner as in Example 17 above, the molybdenum substrate was placed in the glow discharge deposition chamber 701, and then the interior of the deposition chamber was evacuated to a vacuum degree of $5\times10^{-6}$ torr. While maintaining the substrate at a temperature of 300° C., an auxiliary valve 740 was made full open, and subsequently the flow-out valves 725, 726,727 and the flow-in valves 720, 721, 722 were made full open. At the same time, flow meters 716, 717, 718 were also completely de-aerated in its interior to be brought to the vacuum condition. After closure of the auxiliary valve 740, the flow-out valves 725, 726, 727, 728 and the flow meters 716, 717, 718, 719 were closed, after which the valve 730 of the bomb 711 containing therein $SiF_4$ gas (99.999% purity), the valve 731 of the bomb 712 containing therein hydrogen gas, and a valve 733 of a bomb 714 containing therein $PH_3$ gas (99.999% purity) were opened. By adjusting a pressure at respective outlet pressure gauges 735, 736, 738 to 1 kg/cm$^2$, and gradually opening the flow-in valves 720, 721, 723, $SiF_4$ gas, hydrogen gas, and $PH_3$ gas were caused to flow into the flow meters 716, 717, 719, respectively. Subsequently, the flow-out valves 725, 726 were gradually opened, and then the auxiliary valve 740 was also opened. At this instant, the flow-in valves 720, 721 were so adjusted that a ratio between the flow rate of $SiF_4$ gas and the flow rate of hydrogen gas may be 10:1. Next, opening of the auxiliary valve 740 was adjusted, while watching the Pirani gauge 741, until the deposition chamber 701 attained the vacuum degree of $1\times10^{-2}$ torr. Upon stabilization of the internal pressure of the deposition chamber 701, the main valve 710 was gradually constricted until the Pirani gauge 741 indicated a value of 0.5 torr. Verifying that the internal pressure of the deposition chamber 701 had become stabilized, and subsequently closing a switch for a high frequency power source 742, a high frequency power of 13.56 MHz was applied to an induction coil 743 (on the upper part of the chamber) to generate glow discharge within the deposition chamber 701 at the coil portion, thereby obtaining an input power of 10 W. Under the afore-described conditions, the a-semiconductor layer was started to grow on the substrate, and, at the same time, the flow-out valve 728 was started to open gradually, and it was continuously increased in six hours until the flow meter 719 indicated the $SiF_4$ gas flow rate of 0.03% from its state of zero percent.

After the a-semiconductor layer was grown on the substrate under the abovementioned conditions which was kept for six hours, the high frequency power source 742 was opened to cease the glow discharging. In this state, the flow-out valve 728 and the flow-in valve 723 were closed after lapse of a certain length of time, and then the valve 732 of the $B_2H_6$ gas bomb 713 was opened, a pressure in an outlet pressure gauge 737 was adjusted to 1 kg/cm$^2$, and the flow-in valve 722 was gradually opened to cause $B_2H_6$ gas to flow into the flow meter 718, after which the flow-out valve 727 was gradually opened, and then the opening of the flow-out valve 728 was set in such a manner that the flow meter 718 could stably indicate the $SiF_4$ gas flow rate of 0.008 vol %.

Subsequently, the high frequency power source 742 was again turned on to resume the glow discharge. After continuing the glow discharging for further eight minutes, the heater 708 was turned off, and the high frequency power source 742 was also brought to its off state. As soon as the substrate temperature indicated 100° C., the flow-out valves 725, 726, 727 and the flow-in valves 720, 721, 722 were closed, while opening the main valve 710, to render the internal vacuum degree of the deposition chamber 701 to be $10^{-5}$ torr or below. After this, the main valve 710 was closed and the interior of the chamber 701 was rendered atmospheric by opening the leak valve 743, and the substrate was taken out. In this case, the total thickness of the photoconductive layer thus formed was approximately 12 microns.

When the thus obtained image forming member was placed in an experimental device for charging and exposing, and subjected to the image forming test as in Example 17 above, there was obtained on the image transfer paper a toner image of extremely good quality and a high image contrast in the case of using a negative corona discharge of −5.5 KV and a positively charged developer in combination.

EXAMPLE 19

In the same manner as in Example 17 above, the molybdenum plate was placed in the glow discharge deposition chamber 701, and then the interior of the deposition chamber was evacuated to a vacuum degree of $5\times10^{-6}$ torr. While maintaining the substrate at a temperature of 300° C., the flow-in systems for $SiF_4$ gas, hydrogen gas, $B_2H_6$ gas, and $PH_3$ gas were rendered vacuum of $5\times10^{-6}$ torr. After the auxiliary valve 740, the flow-out valves 725, 726, 727, 728, and the flow-in valves 720, 721, 722, 723 were closed, the valve 730 of the $SiF_4$ gas bomb 711, the valve 731 of the hydrogen gas bomb 712, the valve 732 of the $B_2H_6$ gas bomb 713 were opened. By adjusting a pressure at the respective outlet pressure gauges 735, 736, 737 at 1 kg/cm$^2$ and gradually opening the flow-in valves 720, 721, 722, $SiF_4$ gas, hydrogen gas and $B_2H_6$ gas were caused to flow into the flow meters 716, 717, 718. Successively, the flow-out valves 725, 726 were gradually opened, and then the auxiliary valve 740 was also opened. At this instant, the flow-in valves 720, 721 were so adjusted that a ratio between the flow rate of $SiF_4$ gas and the flow rate of hydrogen gas might be 10:1. Next, opening of the auxiliary valve 740 was adjusted, while watching the Pirani gauge 741, until the interior of the deposition chamber 701 attained the vacuum degree of $1\times10^{-2}$ torr. Upon stabilization of the internal pressure of the deposition chamber 701, the main valve 710 was gradually constricted until the Pirani gauge 741 indicated a value of 0.5 torr. At this instant, $SiF_4$ gas and hydrogen gas were mixed with $B_2H_6$ gas and caused to flow in the deposition chamber 701 from the $B_2H_6$ gas bomb 713 through the valve 732 in such a manner that the $B_2H_6$ gas might be in a quantity of 0.003 vol % with respect to $SiF_4$ gas, the mixing of which was done by adjusting the flow-in valve 722 and the flow-out valve 727 to a gas pressure of 1 kg/cm$^2$ (as indicated by the output pressure gauge 737), in accordance with indication of the flow meter 718. As soon as the gas in-flow became stabilized, the pressure in the chamber interior became constant, and the substrate temperature was stabilized at 300° C., the high frequency power source 742 was turned on to start the glow discharging, as is the case with Example 17 above, thereby growing the a-semiconductor layer on the substrate. At the same time, the flow-out valve 727 was started to gradually open, and the opening of the flow-out valve 727 was continuously increased in 5.5 hours so that the flow meter 718 could indicate the $SiF_4$ gas flow rate of from 0.003 vol % to 0.008 vol %. Thereafter, the flow rate of $B_2H_6$ gas was made 0.008 vol % with respect to the flow rate of $SiF_4$ gas, which condition was maintained for 30 minutes. After the a-semiconductor layer was grown on the substrate for six hours under the afore-mentioned conditions, the high frequency power source 742 was turned off to cease the glow discharging. In this state, the flow-out valve 727 and the flow-in valve 722 were closed, and then the valve 733 of the $PH_3$ gas bomb 714 was opened. By adjusting the pressure in the outlet pressure gauge 728 to 1 kg/cm$^2$, and gradually opening the flow-in valve 723, the $PH_3$ gas was caused to flow in the flow meter 719, after which the flow-out valve 728 was gradually opened to set its opening in such a manner that the flow meter 719 could indicate the $SiF_4$ gas flow rate of 0.003 vol %, and stabilized.

Subsequently, the high frequency power source 742 was again turned on to resume the glow discharge. After continuing the glow discharging for further eight minutes, a heater 708 was turned off, and the high frequency power source 742 was also brought to its off state. As soon as the substrate temperature indicated 100° C., the flow-out valves 725, 726, 728 and the flow-in valves 720, 721, 723 were closed, while opening the main valve 710, to render the internal vacuum degree of the deposition chamber 701 to be $10^{-5}$ torr or below. After this, the main valve 710 was closed and the interior of the chamber 701 was rendered atmospheric by opening a leak valve 744, and then the substrate was taken out. In this case, the total thickness of the photoconductive layer thus formed was approximately 14 microns.

The thus obtained image forming member was subjected to the positive corona discharge in the dark with the power source voltage of 6,000 volts, followed by the image exposure with an exposure light quantity of 5 lux.sec., thereby forming an electrostatic image. This electrostatic image was developed with a negatively charged toner by means of the cascade method, followed by image transfer and fixation on an image transfer paper. An extremely clear image could be obtained.

EXAMPLE 20

Figure 8:
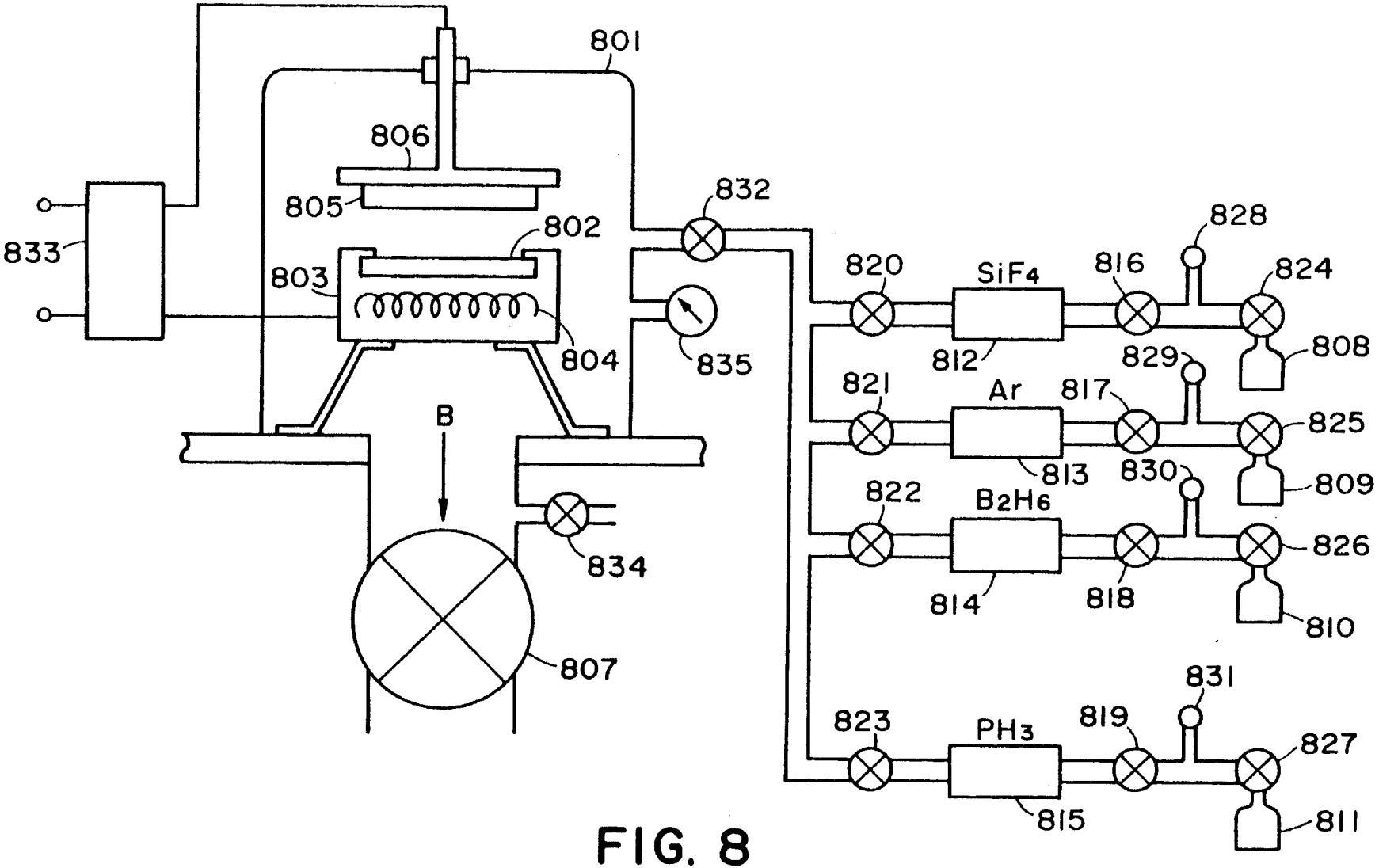

Using the device shown in FIG. 8, the electrophotographic image forming member was manufactured in accordance with the process steps to be mentioned hereinbelow.

A substrate was prepared by vapor-deposition of a thin platinum film of approximately 800 Å thick, by the electron beam vacuum evaporation method, on a stainless steel plate of 10 cm×10 cm and 0.2 mm thick with its surface having been cleaned. This substrate was fixed on a fixing member 803 with a heater 804 and a thermocouple incorporated therein, and installed in a sputtering deposition chamber 801. On an electrode 806 opposite to the substrate 802, there was fixed a polycrystalline silicon plate target 805 (having purity of 99.999%) in a manner to be parallel with the substrate 802 and opposite thereto with a space interval of about 8.5 cm.

The interior of the deposition chamber 801 was once evacuated to approximately $1\times10^{-6}$ torr by full opening of the main valve 807 (at which time the entire valves in the system are closed), and further perfectly de-aerated by opening the auxiliary valve 832 and the flow-out valves 820, 821, 822, and 823, after which the flow-out valves 820, 821, 822, 823 and the auxiliary valve 832 were closed.

The substrate 802 was maintained at 250° C. by turning on the heater 804. Then, a valve 824 of a bomb 808 containing therein $SiF_4$ (having purity of 99.99995%) was opened, and the outlet pressure was adjusted to 1 kg/cm$^2$ by an outlet pressure gauge 828. Successively, the flow-in valve 816 was gradually opened to cause $SiF_4$ gas to flow into the flow meter 812. Thereafter, the flow-out valve 820 was gradually opened, and further the auxiliary valve 832.

The internal pressure of the deposition chamber 801 was brought to the vacuum degree of $5\times10^{-4}$ torr by adjusting the flow-out valve 820, while it was being detected by the Pirani gauge 835. Successively, a valve 825 of a bomb 809 containing therein argon gas (having a purity of 99.9999%) was opened to adjust that the outlet pressure gauge 829 indicated a pressure value of 1 kg/cm$^2$, after which the flow-in valve 817 was opened, and the flow-out valve 821 was gradually opened, thereby introducing argon gas into the deposition chamber. The flow-out valve 823 was still gradually opened until the Pirani gauge 835 indicated the vacuum degree of $1\times10^{-3}$ torr. In this state, the main valve 807 was gradually closed when the flow rate became stable, and it was further constricted until the internal pressure of the deposition chamber 801 became $1\times10^{-2}$ torr. Continuously, the valve 827 of the bomb 811 containing $PH_3$ gas (having a purity of 99.9995%) was opened, and, after adjustment of the outlet pressure gauge 831 to a pressure value of 1 kg/cm$^2$, the flow-in valve 819 was opened, then the flow-out valve 823 was gradually opened, and, while watching the flow meter 815, the valve 823 was adjusted in such a manner that $SiF_4$ gas could flow at a flow rate of approximately 0.5 vol % with respect to the flow rate indicated by the flow meter 812. After verifying that the flow meters 812, 813, 814 became stabilized, the high frequency power source 833 was turned on, and a high frequency voltage input of 13.56 MHz and 1 KV was applied across the target 805 and the fixing member 803. Formation of the layer was carried out by taking a matching so as to continue a stable discharge under this condition. Thus, the discharge was continued for four hours to form the inner layer. Thereafter, the high frequency power source 833 was turned off to once cease the discharge. Successively, both flow-out valve 823 and flow-in valve 819 were closed. Then, the valve 826 of the bomb 810 containing therein $B_2H_6$ gas (having a purity of 99.9995%) was opened, and, after adjustment of the outlet pressure gauge 830 to an outlet pressure value of 1 kg/cm$^2$, the flow-in valve 818 was opened along with the gradual opening of the flow-out valve 822 so that the flow rate of $B_2H_6$ gas may be adjusted by the flow meter 814 to be 1.0 vol % with respect to the flow rate of $SiF_4$ gas. As soon as the flow rates of $SiF_4$ argon, and $B_2H_6$ gases had become stabilized, the high frequency power source 833 was turned on again to apply a high frequency voltage of 1.0 KV to resume the discharging. After continuing the discharge for 40 minutes under this condition, the high frequency power source 833 was turned off, and the power source for the heater 804 was also turned off. As soon as the substrate temperature reaches 100° C. or below, the flow-out valves 820, 821, 822 and the flow-in valves 816, 817, 818, as well as the auxiliary valve 832 were closed, after which the main valve 807 was made full open, thereby evacuating the gas within the deposition chamber. Thereafter, the main valve 807 was closed and the leak valve 834 was opened to make the deposition chamber interior to be atmospheric, and the substrate was taken out. In this case, thickness of the photoconductive layer thus formed was 6 microns.

The thus obtained image forming member was subjected to the same test as in Example 17 above, whereupon an image excellent in the image resolution, gradation, and image density could be obtained in the case of using a negative corona charge of −5.5 KV and a positively charged developer in combination.

EXAMPLE 21

Under and following the same conditions and procedures as in Example 19 above, the a—Si:X layer of 14 microns thick was formed on the molybdenum substrate, after which the coated substrate was taken outside the deposition chamber 701, followed by coating of polycarbonate resin onto the a—Si:X layer in such a manner that the thickness of the resin coating after drying might be 15 microns, thereby forming the electrically insulating layer. The thus obtained electrophotographic image forming member was subjected to the negative corona charging at a source voltage of 5,500 V for 0.2 sec. as the primary charging on the surface of the insulating layer, whereupon it was charged to −2,000 V. Subsequently, the image forming member was subjected to the positive corona discharge at a source voltage of 6,000 V as the secondary charging with simultaneous image exposure with an exposure light quantity of 4 lux.sec., followed by uniform, overall irradiation of the surface of the image forming member, thereby forming an electrostatic latent image. This electrostatic image was developed with a positively charged toner by means of the cascade method, and the developed toner image was transferred onto an image transfer paper, and fixed. An image of extremely good image quality could be obtained. The same good quality of the initial image could be maintained even after repeated process for reproduction of more than 100,000 sheets of copies.

EXAMPLE 22

An a—Si:X layer of 14 microns thick was formed on an aluminum substrate in the same manner as in Example 19 above with the exception that the substrate used was an aluminum plate with its surface having been subjected to almite-treatement, thereby producing the electrophotographic image forming member.

The electrophotographic image forming member was subjected to the image forming process on the image transfer paper under the same conditions and following the same procedures as in Example 19 above, whereupon a clear image having high image resolution could be obtained.

EXAMPLE 23

On one surface side of a glass material (Corning #7059 Glass having a dimension of 4 cm×4 cm×1 mm thick with both surfaces glazed), the surface of which had been cleaned beforehand, ITO ($In_2O_3$:$SnO_2$=20:1, shaped and calcined 600° C.) was vacuum-deposited to a thickness of 1,200 Å, followed by heat-treatment at 500° C. in an oxygen atmosphere, thereby obtaining a substrate for the image forming member.

The substrate was placed on the fixing member 703 of the apparatus as used in Example 17 above (FIG. 3) with the ITO-deposited surface turned upward. Subsequently, the interior of the glow discharge deposition chamber 701 was evacuated to $5\times10^{-6}$ torr by the same operations as done in Example 17. While maintaining the substrate temperature at 270° C., both $SiF_4$ gas and hydrogen gas were caused to flow into the deposition chamber, and the chamber interior was adjusted to a value of 0.8 torr. Further, $PH_3$ gas was introduced into the deposition chamber 701 in mixture with $SiF_4$ gas and hydrogen gas, from the $PH_3$ gas containing bomb 714 through the valve 733, in such a manner that its ratio may be 0.05 vol % with respect to $SiF_4$ gas by adjustment of the flow-in valve 723 and the flow-out valve 728 at a gas pressure of 1 kg/cm$^2$ (according to the indication of the output pressure gauge 738), while monitoring the flow meter 719. As soon as the in-flow gas became stabilized, the internal pressure of the deposition chamber 701 became constant, and the substrate temperature became stabilized at 270° C., the high frequency power source 742 was turned on in the same manner as in Example 17 to start the glow discharge. After the glow discharging was continued for 10 minutes under the abovementioned conditions, the high frequency power source 742 was turned off to cease the glow discharge, thereby completing formation of the inner layer. Thereafter, both flow-out valve 728 and flow-in valve 723 were closed. After lapse of a certain length of time, the high frequency power source 742 was again turned on to resume the glow discharging, and, after maintaining this condition for 4 hours, the high frequency power source was turned off to cease the glow discharging. Continuously, the valve 732 of the bomb 713 containing therein $B_2H_6$ gas was opened, and, after adjusting a pressure in the outlet pressure gauge 737 to 1 kg/cm$^2$ the flow-in valve 722 was gradually opened to cause $B_2H_6$ gas to flow into the flow meter 718. Further, the flow-out valve 727 was gradually opened, and its opening was set until the flow meter 718 indicated the $B_2H_6$ gas flow rate of 0.008 vol % with respect to the $SiF_4$ gas flow rate, so that the flow rate of $B_2H_6$ into the deposition chamber 701 may stabilize together with the flow rates of $SiF_4$ gas and hydrogen gas. Subsequently, the high frequency power source 742 was again turned on to start the glow discharging, which was continued for 10 minutes under the same conditions. Thereafter, the heater 708 and the high frequency power source was turned off to cool the substrate temperature to 100° C. Then, the flow-out valves 725, 726, 727, and the flow-in valves 720, 721, 722 were closed, while opening the main valve 710 to the full extent, to once evacuate the deposition chamber 701 to a value of $10^{-5}$ torr or below, after which the main valve 710 was closed to render the chamber 701 to be atmospheric by opening the leak valve 743, and the substrate was taken outside. The entire a—Si:X layer thus formed had a thickness of about 9 microns.

When the thus obtained electrophotographic image forming member was placed in the experimental device for charging and image exposing same as that used in Example 1 above, and subjected to the image forming test, there could be obtained on the image transfer paper a toner image of extremely good quality and high image contrast in the case of using a negative corona charging at −5.5 KV and a positively charged developer in combination.

EXAMPLE 24

Using the glow discharge deposition device shown in FIG. 7, the electrophotographic image forming member was fabricated in the undermentioned manner, and the thus obtained image forming member was subjected to the image developing process for required image formation.

At first, a molybdenum plate (substrate) 709 of 0.2 mm in thickness and 5 cm in diameter, which had been cleaned by the same surface treatment as, in Example 17 above, was firmly fixed on the fixing member 703 mounted at a predetermined position in the glow discharge deposition chamber 701. After verifying that the entire valves in the system were closed, the main valve 710 was made full open to discharge air within the chamber 701 to bring the vacuum degree to approximately $5\times10^{-6}$ torr. Thereafter, an input voltage to a heater 708 was increased to heat the substrate to a stabilized constant value of 200° C. by varying the input voltage, while detecting the temperature of the molybdenum substrate.

Then, the auxiliary valve 740, the flow-out valves 725, 727, 729, and the flow-in valves 720, 722, 724 were sequentially made full open, whereby the interior of the flow meters 716, 718, 720 was sufficiently de-aerated and rendered vacuum After the auxiliary valve 740, the flow-out valves 725, 727, 729, and the flow meters 716, 718, 720 were closed, the valve 730 of the bomb 711 containing therein $SiF_4$ gas (99.999% purity) and the valve 734 of the bomb 715 containing therein $SiH_4$ gas were opened. Then, adjusting a pressure in the outlet pressure gauges 735, 739 to 1 kg/cm$^2$, the flow-in valves 720, 724 were gradually opened to cause $SiF_4$ gas and $SiH_4$ gas to flow into the flow meters 716, 720*a*. Successively, the flow-out valves 725, 729, and then, the auxiliary valve 740, were gradually opened. At this instant, the flow-in valves 720, 724 were so adjusted that a ratio between the flow rate of $SiF_4$ gas and the,flow rate of $SiH_4$ gas could become 4:6. Following this, the opening of the auxiliary 20 valve 740 was adjusted, while watching the Pirani gauge 741, until the vacuum degree in the chamber 710 became $1\times10^{-2}$ torr. As soon as the internal pressure of the chamber 701 became stabilized, the main valve 710 was gradually closed to constrict the opening until the Pirani gauge 741 indicated a value of 0.7 torr. Subsequently, by closing the switch for the high frequency power source 742, a high frequency power of 13.56 MHz was supplied to an induction coil 743 (on the upper part of the chamber) to generate glow discharge within the deposition chamber 701 at the coil portion, thereby obtaining an input power of 25 W. Under the afore-described conditions, a-semiconductor layer was grown on the substrate to form the photoconductive layer. After maintaining the same conditions for three hours, the high frequency power source 742 was opened to cease the glow discharging. Subsequently, $B_2H_6$ gas was introduced into the deposition chamber 701, in mixture with $SiF_4$, from the bomb 713 containing therein $B_2H_6$ gas through the valve 732, at a gas pressure of 1 kg/cm$^2$ by adjusting the flow-in valve 722 and the flow-out valve 727, while monitoring the flow meter 718, so that it may be in a quantity of 0.006 vol % with respect to the flow rate of $SiF_4$ gas. As soon as the in-flow gas became stabilized, the high frequency power source 742 was turned on to commence the glow discharging. After continuing the glow discharging for eight minutes, the high frequency power source 742 and the heater 708 were turned off to cool the substrate to 100° C. When the substrate temperature reached that level, the flow-out valves 725, 727, 729 and the flow-in valves 720, 722, 724 were closed, while fully opening the main valve 710 to once evacuate the deposition chamber 701 to a value of $10^{-5}$ torr. After this, the main valve 710 was closed and the leak valve 744 was opened to reinstate the interior of the deposition chamber 701 to the atmospheric condition, and the substrate was taken outside. The total thickness of the photoconductive layer thus formed was approximately 8 microns.

When the thus obtained electrophotographic image forming member was subjected to the image forming process steps of charging, exposing, developing, and image transferring in the same manner as in Example 17 above, there could be obtained on the image transfer paper a toner image of extremely good quality.

EXAMPLE 25

In the same manner as in Example 17 above, the molybdenum substrate was placed in the glow discharge deposition chamber 701, and then the interior of the deposition chamber was evacuated to a vacuum degree of $5\times10^{-6}$ torr. While maintaining the substrate at a temperature of 300° C., the auxiliary valve 740 was made full open, and the flow-out valves 725, 726, 727, 729 and, the flow-in valves 720, 721, 722, 724 were made full open. At the same time, the flow meters 716, 717, 718, 720 were also completely de-aerated in its interior to be brought to the vacuum condition. After closure of the auxiliary valve 740, the flow-out valves 725, 726, 727, 729 and the flow-in valves 720, 721, 722, 724, a valve 734 of a bomb 715 containing therein $SiF_4$ gas and a valve 731 of a bomb 712 containing therein hydrogen gas were opened. By adjusting a pressure in the respective outlet pressure gauges 739, 736 to 1 kg/cm$^2$ and gradually opening the flow-in valves 724, 721, $SiF_4$ gas and hydrogen gas were caused to flow into the flow meters 720, 717, respectively. Subsequently, the flow-out valves 729, 726 were gradually opened, and then the auxiliary valve 740 was also opened gradually. At this instant, the flow-in valves 724, 721 were so adjusted that a ratio between the flow-rate of $SiF_4$ gas and the flow-rate of hydrogen gas could be 1:5. Next, opening of the auxiliary valve 740 was adjusted, while watching the Pirani gauge 741, and it was opened until the deposition chamber 701 interior attained the vacuum degree of $1\times10^{-2}$ torr. Upon stabilization of the internal pressure of the deposition chamber 701, the main valve 710 was gradually constricted until the Pirani gauge 741 indicated a value of 0.2 torr. Verifying that the internal pressure of the deposition chamber 701 had become stabilized, and subsequently closing a switch for a high frequency power source 742, a high frequency power of 13.65 MHz was supplied to an induction coil 743 (on the upper part of the chamber) to generate glow discharge within the deposition chamber 701 at the coil portion, thereby obtaining an input power of 10 W. Under the afore-described conditions, the a-semiconductor layer was grown on the substrate.

After a-semiconductor layer (inner layer) was grown on the substrate under the abovementioned conditions, which was maintained for eight hours, the high frequency power source 742 was turned off to stop the glow discharging, in which state the flow-out valve 729 and the flow-in valve 724 were closed. On this a-semiconductor layer, there was further formed, as the outer layer, the a—Si:X layer doped with boron by the same operation as in Example 1 above. The total thickness of the thus formed photoconductive layer was approximately 6 microns.

When the thus obtained image forming member was placed in an experimental device for charging and exposing, and subjected to the image forming test as in Example 1 above, there was obtained on the image transfer paper a toner image of extremely good quality and high image contrast with a combination of a negative corona discharge of −5.5 KV and a positively charged developer.

What we claim is:

1. A process for producing an electrophotographic image forming member, which comprises the steps of:

(a) providing in a film-forming space a substrate at least the surface of which is conductive and introducing into the film-forming space at least (i) a silicon-atom containing gas and a halogen-atom containing gas or (ii) a gas containing silicon atoms and halogen atoms as starting gas;

(b) generating a glow discharge sufficient to heat the substrate to a temperature from 100° to 550° C. under a reduced pressure;

(c) forming a deposited film on the substrate by the glow discharge; and (d) removing the substrate having the deposited film formed thereon from the film-forming space after the temperature of the substrate is reduced below the film-forming temperature of step (b), whereby an amorphous material comprising silicon atoms as a matrix and halogen atoms in a content of 1 to 40 atomic percent is formed as a photoconductive layer on the substrate.

2. The process according to claim 1, wherein the silicon-atom containing gas is at least one selected from the group consisting of $SiH_4$, $Si_2H_6$, $Si_3H_8$, $Si_4H_{10}$, $SiF_4$ and $Si_2F_6$.

3. The process according to claim 1, wherein the halogen-atom containing gas is at least one selected from the group consisting of hydrogen halides, halogen-substituted hydrogenated silicons, halogen-substituted paraffin type hydrocarbons and halogenated silicons.

4. A process according to claim 3, wherein the hydrogen halides are HF, HCl, HBr or HI.

5. A process according to claim 3, wherein the halogen-substituted hydrogenated silicons are $SiH_2F_2$, $SiH_2Cl_2$, $SiHCl_3$, $SiH_2Br_2$ or $SiHBr_3$.

6. The process according to claim 3, wherein the halogen-substituted paraffin type hydrocarbons are $CHF_3$, $CH_2F_2$, $CH_3F$, $CH_3Cl$, $CH_3I$ or $C_2H_5Cl$.

7. The process according to claim 3, wherein the halogenated silicons are $SiF_4$ or $Si_2F_6$.

8. The process according to claim 1, wherein the gas containing both silicon atoms and halogen atoms is employed.

9. The process according to claim 1, wherein the amorphous material further contains hydrogen atoms.

10. The process according to claim 9, wherein the total of the hydrogen atom content and the halogen atom content of the amorphous material ranges from 1 to 40 atomic percent.

11. The process according to claim 1, wherein the temperature lower than the film-forming temperature is 100° C.

* * * * *

UNITED STATES PATENT AND TRADEMARK OFFICE

CERTIFICATE OF CORRECTION

PATENT NO. : 5,561,024

DATED : October 1, 1996

INVENTOR(S) : TADAJI FUKUDA ET AL.

It is certified that error appears in the above-identified patent and that said Letters Patent is hereby corrected as shown below:

ON THE TITLE PAGE:

AT [76] INVENTORS:

"[76] Inventors: Tadaji Fukuda; Toshiyuki Komatsu, both of c/o Canon Kabushiki Kaisha 30-2, 3-chome, Shimomaruko, Ohta-ku, Tokyo, Japan" should read --[75] Inventors: Tadaji Fukuda, Kawasaki; Toshiyuki Komatsu, Yokohama, both of Japan--.

AT [73] ASSIGNEE

Insert, --[73] Assignee: Canon Kabushiki Kaisha, Tokyo, Japan--.

AT [30] FOREIGN APPLICATION PRIORITY DATA

"Dec. 13, 1979 [JP] Japan ..... 161872
Dec. 26, 1979 [JP] Japan ..... 169576" should read
--Dec. 13, 1979 [JP] ..... 54-161872
Dec. 26, 1979 [JP] ..... 54-169576--.

AT [56] REFERENCES CITED

Insert, --Attorney, Agent or Firm—Fitzpatrick, Cella, Harper & Scinto--.

UNITED STATES PATENT AND TRADEMARK OFFICE

CERTIFICATE OF CORRECTION

PATENT NO. : 5,561,024

DATED : October 1, 1996

INVENTOR(S) : TADAJI FUKUDA ET AL.

It is certified that error appears in the above-identified patent and that said Letters Patent is hereby corrected as shown below:

COLUMN 1

Line 54, "spectro-scopic" should read --spectroscopic--.

COLUMN 2

Line 63, "afore-mensioned" should read --aforementioned--.

COLUMN 3

Line 4, "cleaning" should read -cleaning property, moisture-resistant property, and so on.--.

COLUMN 6

Line 15, "photocOnductive" should read --photoconductive--.

COLUMN 7

Line 11, "as" should read --as an--.
Line 25, "optimumly" should read --optimally--.
Line 39, "activated." should read --activated--.
Line 46, "By" should read --B,--.

COLUMN 8

Line 55, "etc" should read --etc.--.

UNITED STATES PATENT AND TRADEMARK OFFICE

CERTIFICATE OF CORRECTION

PATENT NO. : 5,561,024

DATED : October 1, 1996

INVENTOR(S) : TADAJI FUKUDA ET AL. Page 3 of 4

It is certified that error appears in the above-identified patent and that said Letters Patent is hereby corrected as shown below:

COLUMN 11

Line 4, "either." should read --either--.
Line 15, "NaβNd≈0" should read --Na≈Nd≈0--.
Line 16, "Na≈Nd." should read --Na≈Nd.--.

COLUMN 13

Line 52, "that the" should read --that--.

COLUMN 14

Line 14, "the." should read --the--.
Line 23, "an." should read --an--.

COLUMN 17

Table 3, "10" should read --18--.

COLUMN 18

Line 14, "10 atomic %." should read --$10^{-4}$ atomic %.--.

COLUMN 19

Line 66, "f" should read --of-- and
"electronstatic" should read --electrostatic--.

COLUMN 22

Line 19, "the entire" should read --all the--.

UNITED STATES PATENT AND TRADEMARK OFFICE

CERTIFICATE OF CORRECTION

PATENT NO. : 5,561,024

DATED : October 1, 1996

INVENTOR(S) : TADAJI FUKUDA ET AL.

It is certified that error appears in the above-identified patent and that said Letters Patent is hereby corrected as shown below:

COLUMN 30

Line 57, "the entire" should read --all the--.

COLUMN 31

Line 13, "the, flow" should read --the flow--.
Line 15, "20" should be deleted.

Signed and Sealed this

Tenth Day of June, 1997

Bruce Lehman

*Attest:*

BRUCE LEHMAN

*Attesting Officer*

*Commissioner of Patents and Trademarks*